US012404784B2

(12) United States Patent
Stankovic

(10) Patent No.: US 12,404,784 B2
(45) Date of Patent: Sep. 2, 2025

(54) MODIFIED RANKINE CYCLE WITHOUT HEAT REJECTION, DRIVEN BY A WET-VAPOR-REGION THERMOCOMPRESSOR

(71) Applicant: Branko Stankovic, Toronto (CA)

(72) Inventor: Branko Stankovic, Toronto (CA)

( * ) Notice: Subject to any disclaimer, the term of this patent is extended or adjusted under 35 U.S.C. 154(b) by 22 days.

(21) Appl. No.: 18/364,739

(22) Filed: Aug. 3, 2023

(65) Prior Publication Data

US 2024/0191640 A1 Jun. 13, 2024

(51) Int. Cl.

| | |
|---|---|
| ***F01K 15/00*** | (2006.01) |
| ***F01K 7/16*** | (2006.01) |
| ***F01K 21/04*** | (2006.01) |

(52) U.S. Cl.

CPC ..... *F01K 15/00* (2013.01); *F01K 7/16* (2013.01); *F01K 21/042* (2013.01); *F01K 21/047* (2013.01)

(58) Field of Classification Search

CPC ..... F01K 15/00; F01K 7/16; F01K 21/042; F01K 21/047; F01K 21/005; F01K 19/08

See application file for complete search history.

(56) References Cited

U.S. PATENT DOCUMENTS

| | | | | |
|---|---|---|---|---|
| 3,686,867 A * | 8/1972 | Hull | F04F 5/54 | 60/667 |
| 3,972,196 A * | 8/1976 | Silvestri, Jr. | F01K 17/06 | 60/715 |
| 4,442,675 A * | 4/1984 | Wilensky | F01K 21/00 | 60/688 |
| 6,877,960 B1 * | 4/2005 | Presz, Jr. | F04F 5/46 | 417/183 |
| 11,199,361 B2 * | 12/2021 | Chudnovsky | F01K 19/10 | |
| 2010/0186409 A1 * | 7/2010 | Hertel | F01K 7/40 | 60/653 |
| 2015/0369125 A1 * | 12/2015 | Reiter | F02C 1/04 | 60/39.182 |

FOREIGN PATENT DOCUMENTS

WO WO-2020035470 A1 * 2/2020

* cited by examiner

*Primary Examiner* — Jesse S Bogue

(57) ABSTRACT

The disclosed concept relates to a novel modified and simplified Rankine steam-turbine cycle without rejection of heat in the cycle, which is driven by a thermocompressor (ejector) operating in the wet-vapor region, to the end of achieving of the maximum possible (~100%) thermal efficiency of the thus modified Rankine cycle. Wet-vapor mixture circulating within the thermocompressor is being separated in a cylindrical separation tank, so that the saturated water is pumped to a water heater where it receives the cycle heat input, while the saturated vapor is expanded in a backpressure steam turbine producing useful mechanical work and is then recirculated back to the thermocompressor, where it is being re-pressurized by the primary fluid (pumped and heated saturated water). The concept can be applied to steam-turbine-cycle power-plants fueled by: coal or solid/liquid/waste fuel, nuclear fuel (using boiling water reactors, pressurized water reactors, pressurized heavy-water reactors, gas-cooled reactors, molten salt reactors or liquid-metal-cooled fast reactors) or renewable energy sources (Solar energy, biomass, geothermal), The concept can also be used in the form of the bottoming steam-turbine-cycle part of a combined gas-turbine/steam-turbine cycle power plant.

9 Claims, 23 Drawing Sheets

MODIFIED RANKINE CYCLE WITHOUT HEAT REJECTION, DRIVEN BY A WET-VAPOR-REGION THERMOCOMPRESSOR

FIELD OF THE INVENTION

The present invention relates to a novel modified and simplified Rankine steam-turbine cycle without rejection of the cycle heat, which is driven by a thermocompressor (ejector) operating in the wet-vapor region, being a device known to perform mixing of fluids having different pressure levels and pressure increase of the fluid with lower pressure level, to the end of achieving of the maximum possible thermal efficiency (~100%) of the thus modified Rankine cycle.

BACKGROUND OF THE INVENTION

It is a well-known fact that the simplest and the most straightforward way of decreasing concentration of the main green-house gases (GHGs) in the atmosphere ($CO_2$-gas and water vapor $H_2O$), representing the main ingredients of flue gases resulting from combustion of fossil fuels, and also extending the use of non-renewable (fossil & nuclear) fuels, is to increase/improve the (cycle thermal) energy efficiency of thermal-to-mechanical (electrical) energy conversion for any kind of fossil or nuclear fuel used. Modern combined-cycle gas & steam turbine plants using natural gas (or other hydrocarbon fuels) reach the currently highest cycle thermal efficiency (~64% at lower heating value, LHV) of all thermal engines. In addition, new hybrid concepts have been developed with gas turbines combined with fuel cells, with claimed overall thermal efficiency near 70% (LHV). There has also been an intensive research of new ways of increasing efficiency of thermal energy conversion from coal and nuclear fuels, as worldwide electric power generation still relies considerably on the Rankine (steam-turbine) cycle, which is still the main workhorse of power generation industry. The research and development are going mainly towards the use of either supercritical Rankine cycle (with very high pressures and temperatures of live steam) or integrated coal-gasification combined cycle (IGCC). Being the most abundant fossil fuel on the Earth, coal can be used to produce an alternative fuel, synthetic natural gas (SNG or "syngas") by coal gasification.

It is also a well-known fact to the prior art that steam-jet vacuum ejectors (https://www.koerting.de/en/steam-jet-vacuum-ejector.html) can serve for removal of gases and/or vapors from process operations, generating a vacuum in process vessels and compressing the suction flow to a higher pressure. They serve for start-up evacuation of tanks and reactors component part of multi-stage vacuum units, and also for maintaining vacuum in condensers of steam-turbine power-generating plants operating on a Rankine cycle (https://www.graham-mfg.com/usr/pdf/techlibvacuum/25.pdf). Also, steam-jet ejectors have been used for many years in vapor-jet refrigeration plants and cooling systems (https://grimsby.ac.uk/documents/defra/tech-ejector.pdf), or ejector- or jet-pump refrigeration, as a thermally driven refrigeration technology. Currently, the ejector refrigeration systems have a much lower COP (Coefficient Of Performance) than comparable vapor-compression systems; however, they offer advantages of simplicity and no moving parts.

Prior art, however, rarely recognizes the importance of combining of mixing ejectors/thermocompressors with either gas-turbine-cycle or steam-turbine-cycle power-plants for the purposes of increase of the cycle thermal efficiency and/or the cycle specific work. In this respect, a very illustrative and valuable prior-art document is Serbian Patent No. 56123B1 (https://worldwide.espacenet.com/patent/search/family/054364907/publication/RSS6123B1?g=branko%20stankovic) ("Gas-Turbine-Cycle Power-Plant with Steam Injection and Mixing Ejector Driven by Steam"), granted to the author of the herein disclosed invention, Branko Stankovic, by the Serbian Intellectual Property Office in October 2017. In the cited prior-art document, the author has considered thermal efficiency improvement of steam-injected simple/reheat/double-reheat gas-turbine-cycle power-plant configurations by adding a steam-air mixing ejector driven by the steam raised in a heat recovery boiler. The author rationalizes that the main reason for addition of a steam-driven mixing ejector into a steam-injected gas-turbine (STIGT) cycle power-plant configuration is to obtain more cycle work from the following three reasons: (1) expanding of a larger mass flow rate of the mixed gaseous fluid (air-steam mixture); (2) a somewhat higher GT expansion pressure ratio (due to pressure recovery in the mixing ejector) at the same compressor work; and (3) considerably increased specific heat at constant pressure of the mixed gas (air-steam mixture) due to a twice greater specific heat of steam in comparison with the specific heat of air. Although the cycle heat input also increases from reasons (1) and (3), the achieved cycle thermal efficiency is still considerably increased, due to a considerable relative reduction of the compressor work (from all three above mentioned reasons). The said prior-art document emphasizes use of a sufficiently high ratio of the driving fluid (slightly superheated steam raised in a heat recovery boiler) and the suction/driven fluid (compressed air), to the end of increasing of the mixing-ejector discharge pressure, which is the steam-air mixture pressure ahead of the combustion chamber. To ensure that a sufficient amount of motive steam is raised in the heat recovery boiler, the said prior-art concept uses supplementary firing or reheat of the fully or partially expanded GT working gas, respectively. The cycle thermal efficiency of a single-reheat STIGT cycle with a steam-driven mixing ejector has been estimated at about 66% (LHV) at an assumed maximum heat-addition temperature of 1700 K and assumed isentropic efficiencies of gas turbine and compressor of 90% and 85%, respectively, neglecting ejector frictional effects. Also, the assumed pressure and temperature of motive superheated steam were 30 MPa (300 bar) and 420° C., respectively. In addition, estimated cycle thermal efficiency of a double-reheat STIGT cycle with a steam-driven mixing ejector rose close to 68%, at identical initial assumptions.

Another very illustrative and an equally valuable prior-art document is Serbian Patent No. 57127 B1 ("Recuperated Gas-Turbine-Cycle Power-Plant with Pressurized-Water Driven Mixing Ejector"), granted to the author of the herein disclosed invention, Branko Stankovic, by the Serbian Office in June Intellectual Property 2018 (https://worldwide.espacenet.com/patent/search/family/058185207/publication/RSS7127B1?q=bran ko9620stankovic). In the cited prior-art document, the author has considered thermal efficiency improvement of recuperated gas-turbine-cycle power-plant configurations (recuperated, intercooled/recuperated, reheat/recuperated) by addition of a pressurized-water-driven mixing ejector. Addition of the pressurized-water-driven mixing ejector enables obtaining a greater cycle work due to a considerably higher GT expansion pressure ratio (due to pressure recovery in the two-phase mixing ejector) at the expense of a smaller or none compressor work, at approximately the same heat input, thus yielding a considerably higher cycle thermal efficiency, especially at very low compression pressure ratios (close to unity). In addition, a recuperated GT-cycle power-plant with a water-air mixing ejector with pressurized water as driving fluid can also serve for efficient production of high-pressure low-temperature compressed air, than can be used for a convenient storage of energy through compressed-air storage and its reuse in a gas-turbine power-plant at times when there is a pick or a regular demand for energy consumption. The net cycle thermal efficiency of a recuperated and a single-reheat/recuperated GT cycle with a pressurized-water-driven mixing ejector has been estimated at about 66% (LHV) and 67.5% (LHV), respectively, at an assumed maximum heat-addition temperature of 1700 K, the compression pressure ratio (CPR) of 1.0 (no compressor), at the ratio of mass flow rates of driving fluid (pressurized water) and suction fluid (compressed air) of 10:1, and at assumed isentropic/overall efficiencies of gas turbine, compressor and water pump of 90%, 85% and 70%, respectively, neglecting ejector frictional effects. In addition, at identical initial assumptions, estimated cycle thermal efficiency of a recuperated and a single-reheat/recuperated GT cycle with a pressurized-water/compressed-air-driven mixing ejector has been about 69.3% (LHV), for both recuperated GT-cycle configuration versions.

The state-of-the-art energy conversion systems disclosed and described in the above prior-art documents claim higher-than-conventional cycle thermal efficiencies and also larger-than-conventional cycle specific outputs. However, the claimed thermal efficiencies are still limited by and lower than the in-theory maximum possible thermal efficiency of a thermodynamic cycle operating between a higher temperature (TH) and a lower temperature (Tc), that is, the Carnot-cycle efficiency, defined by the following simple expression:

$$\eta_{th} \leq \eta_{th,Carnot} = \frac{T_H - T_C}{T_H} = 1 - \frac{T_C}{T_H}$$

In general, thermal efficiency (https://en.wikipedia.org/wiki/Thermal_efficiency) of a thermodynamic cycle is defined as the ratio of the difference between the heat added to the cycle ($Q_{in}$) and the heat rejected from the cycle ($Q_{out}$) and the heat added to the cycle ($Q_{in}$):

$$\eta_{th} = \frac{Q_{in} - Q_{out}}{Q_{in}} = 1 - \frac{Q_{out}}{Q_{in}}$$

Obviously, when $Q_{out}$=0, then the cycle thermal efficiency $fi_{th}$=1=100%. This invention shows how can this ideal maximum-thermal-efficiency thermodynamic cycle be practically achieved, thus enabling a much longer use of fossil and nuclear fuels and an efficient reduction of global-warming gases (greenhouse gases) in the Earth's atmosphere.

SUMMARY OF THE INVENTION

The first and the main object of the disclosed invention is to provide a novel modified and simplified Rankine steam-turbine cycle without rejection of the cycle heat, which is driven by a thermocompressor (ejector) operating in the wet-vapor region, to the end of achieving of the maximum possible (~100%) thermal efficiency of the thus modified Rankine cycle. The disclosed invention further reveals that the wet-vapor mixture contained in the modified-Rankine-cycle system and circulating within the thermocompressor is separated in a cylindrical separation tank, so that the saturated water is pumped to a water heater where it receives the cycle heat input, while the saturated vapor is expanded in a backpressure steam turbine producing useful mechanical work and is then recirculated back to the thermocompressor, where it is being re-pressurized by the primary ejector fluid (pumped and heated saturated water). Since the backpressure-steam-turbine's power output largely exceeds the saturated-water-pump's power input and there is no cycle heat rejection, the theoretical maximum thermal efficiency of the thus modified Rankine cycle is close to 100%.

Another important object of the invention is to highlight that the expansion pressure ratio (EPR) of the said backpressure steam turbine must be equal to the pressure recovery ratio of the wet-vapor thermocompressor obtainable at an ejector entrainment ratio (ratio of mass flow rates of suction and driving fluid) defined by the vapor quality at the ejector's diffuser outlet. EPR of the backpressure steam turbine, and thus the ejector entrainment ratio, can be chosen to be a moderate one, say from 2:1 to 4:1, while a lower-than-typical maximum temperature of the cycle heat addition can be used. In relation to this, the invention highlights an option to add a steam compressor to any configuration of the modified Rankine steam-turbine cycle without rejection of the cycle heat, which is used for precompression of the secondary ejector fluid (separated saturated steam/vapor) prior to its expansion in the said backpressure steam turbine, thus artificially increasing the thermocompressor pressure recovery ratio.

Another important object of the invention to disclose that it is possible to arrange the proposed modified Rankine-cycle power-plant with a wet-vapor-region thermocompressor in the 2 (two) following distinctive power-plant configurations:

(1) using a non-superheated (saturated) backpressure steam turbine, with the cycle heat input limited only to the water heater; and (2) using a superheated backpressure steam turbine, where the cycle heat input is applied also to the saturated steam separated in the separation tank, in addition to the water heater.

Another important object of the invention to disclose that it is possible to perform steam/water separation in the cylindrical separation tank of the proposed modified Rankine-cycle power-plant driven by a wet-vapor-region thermocompressor in several different ways, of which the 3 (three) following means of steam/water separation are briefly explained herewith:

(1) a dry-pipe steam separator (located typically within the steam drum of a steam boiler) (http://steamofboiler.blogspot.com/2011/05/steam-separator-in-boiler.html), having of a lot of holes at the top and two holes at the bottom half, whereas the turbulently moving steam-water mixture is directed through the top half holes of the dry pipe and forced to separate between water and steam, whereby the separated steam will flow to the steam turbine and the separated water will drop through bottom holes;

(2) a baffle-plate steam separator (https://www.brainkart.com/article/Steam-separators-(Steam-Driers)_5575/), having the cylindrical separation tank fitted with typically two (2) to three (3) baffle plates, which serve to change the direction of the incoming steam flow when the steam strikes the baffle plates, prompting heavier water particles contained in the steam-water mixture to fall down to the bottom of the separation tank, while the separated steam is freed from water particles and passed to the steam turbine; and (3) a centrifugal/cyclone steam separator typically used in large-scale boilers (http://steamofboiler.blogspot.com/2011/05/steam-separator-in-boiler.html), having the cylindrical separation tank fitted with at least one cyclone, which utilizes centrifugal force to separate water and steam from the steam-water mixture, whereby the steam-water mixture is forced to move around the cyclone and make the rotation; typically, the more turbulent flow forces the mixture to separate more easily.

Another important object of the invention to disclose that it is possible to perform regulation of the cycle output/load of the proposed modified Rankine-cycle power-plant driven by a wet-vapor-region thermocompressor in working regimes other than the nominal working regime using one of the two (2) following methods:

(1) qualitative regulation, that is, regulation of the cycle output/load by alteration of the steam-turbine inlet temperature via the cycle heat input, which, although a quite simple regulation method, can result in a probable existence of a non-stationary normal shock wave somewhere in the mixing-chamber throat of a supersonic wet-vapor mixing thermocompressor/ejector for any change of the cycle load and hence change of the ejector working regime, especially in closed-loop Rankine-cycle power-plant configurations; whereas such a normal shock wave would not necessarily be a weak one, and thus a potential reduction of the recoverable pressure rise in the thermocompressor/ejector would likely be substantial; or (2) quantitative regulation, that is, regulation of the cycle output/load by alteration of the steam-turbine mass flow rate using bypassing of the steam turbine and a subsequent external cooling of the corresponding portion of the steam-turbine bypass mass flow rate up to the steam-turbine outlet temperature existing in the nominal cycle working regime, which, coupled with an appropriate thermocompressor design, should ensure that eventually-occurring normal shock wave is preferably located in the mixing-chamber throat of the supersonic wet-vapor mixing ejector and that it is a weak one, occurring in the vicinity of the unity Mach number (1.0), and also a stationary one at a continually maintained steady-state ejector working regime, and hence a potential reduction of the recoverable pressure rise in the thermocompressor/ejector would likely be minor.

Still another important object of the invention is to highlight that the proposed modified Rankine steam-turbine cycle driven by a wet-vapor-region thermocompressor and without cycle heat rejection can ideally be applied in steam-turbine-cycle power-plant configurations externally-fired by coal or any solid/liquid waste fuel, using either direct heating of the working gas (water/steam) or indirect heating of the working gas (water/steam) via a primary-fluid/secondary-fluid heat exchanger.

Still another important object of the invention is to highlight that the proposed modified Rankine steam-turbine cycle driven by a wet-vapor-region thermocompressor and without cycle heat rejection can also ideally be applied in either directly-heated or indirectly-heated steam-turbine-cycle power-plant configurations fueled by nuclear fuel and using any of the commercially used thermal-neutron nuclear reactors: light-water moderated boiling water reactor (BWR) and pressurized water reactor (PWR), heavy-water moderated pressurized heavy-water reactor (PHWR), graphite-moderated molten salt reactor (MSR) and graphite-moderated gas-cooled reactor (GCR), as well as commercially used fast-neutron nuclear reactors, such as liquid-metal-cooled fast reactor (LMFR).

Still another important object of the invention is to highlight that the proposed modified Rankine steam-turbine cycle driven by wet-vapor-region thermocompressor and without cycle heat rejection can also ideally be applied in either directly-heated or indirectly-heated steam-turbine-cycle power-plant configurations fueled/powered by renewable energy sources, such as: Solar energy, biomass and geothermal energy.

Still another important object of the invention is to highlight that the proposed modified Rankine steam-turbine cycle driven by a wet-vapor-region thermocompressor and without cycle heat rejection can also be very suitably applied as an indirectly-heated bottoming steam-turbine-cycle power-plant of a natural-gas-fired combined gas-turbine/steam-turbine cycle (NGCC).

Finally, still another object of the invention is to emphasize the fact that the proposed modified Rankine steam-turbine cycle driven by a wet-vapor-region thermocompressor is without cycle heat rejection, which means that it also does not include the condensation process, and, consequently the proposed power-plant contains neither the condenser system nor the feedwater heater system, which considerably reduces the capital cost of the proposed modified Rankine-cycle power-plant.

DETAILED DESCRIPTION OF THE INVENTION CONFIGURATIONS

In general, the direction of flow of the various working media on all flow diagrams is marked with arrows: solid line denotes the gaseous working fluid flow or the steam-water flow (where applicable), dashed line denotes an optional cooling-fluid flow, double solid line denotes the combustion air flow (where applicable), while triple solid line denotes the flue-gases flow (where applicable). All flow diagrams shown in different figures that correspond substantially to one another are arranged so that corresponding reference numbers and explanations are valid for common components depicted in such circuit diagrams. Therefore, explanations of such common components are not repeated in the description of similar figures.

Figure 1:
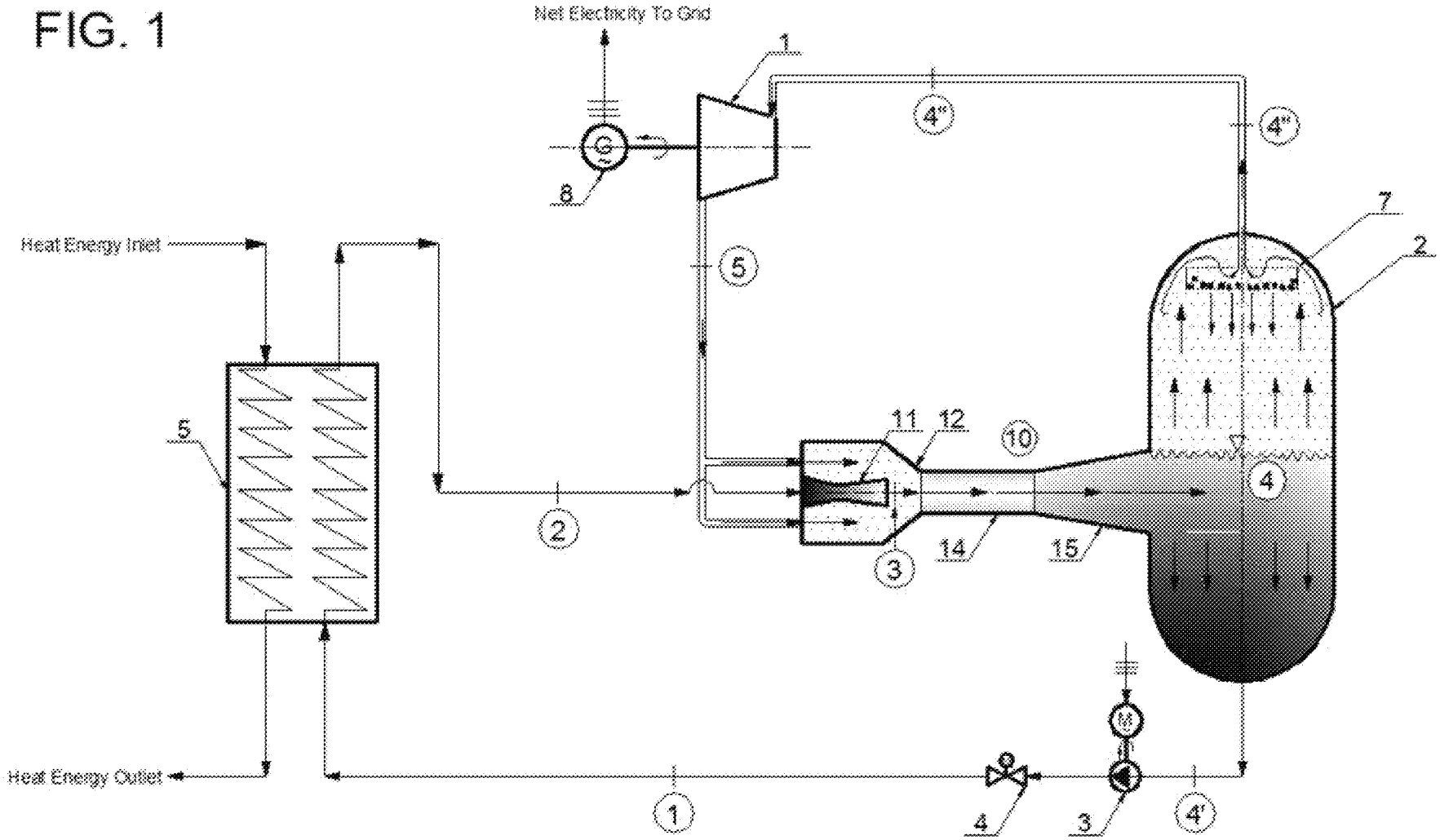
FIG. 1 depicts a flow diagram of an indirectly-heated modified Rankine-cycle power-plant driven by a wet-vapor-region thermocompressor using a non-superheated (saturated) backpressure steam turbine.

A flow diagram of a basic and the first preferred configuration of the modified Rankine-cycle power-plant without cycle-heat rejection driven by a thermocompressor (ejector) operating in the wet-vapor region is depicted in FIG. 1 and it consists of the following interconnected equipment/processes:

(1) a wet-vapor-region thermocompressor/ejector 10, consisting of: a nozzle 11 (typically a supersonic one) for acceleration of the high-pressure high-temperature liquid of a working fluid, typically subcooled water or low-quality liquid-gas (water-vapor) mixture, a conical part 12 of the ejector mixing chamber for admission of exhausted wet vapor from a backpressure steam turbine 1, a long constant-diameter part 14 of the said mixing chamber for mixing and deceleration/acceleration of the liquid-gas (water-vapor) mixture, typically in the form of one or more normal shock waves, and a subsonic diffuser 15 for final (subsonic) deceleration of the mixed liquid-gas (water-vapor) mixture;

(2) a cylindrical separator/separation tank 2 for as-complete-as-possible separation of the wet liquid-gas (water-vapor) mixture exiting the said diffuser 15 of the said thermocompressor 10, which in this case is constructed in the form of a dry-pipe steam separator having of a lot of holes at the top and two holes at the bottom half, whereas the turbulently moving steam-water mixture is directed through the top half holes of the dry pipe and forced to separate between water and steam, whereby the separated steam flows to the said backpressure steam turbine 1 and the separated water drops down to the bulk liquid through bottom holes;

(3) the said backpressure steam turbine 1 for adiabatic expansion of the saturated vapor (gas fraction) separated in the said cylindrical separation tank 2, exhausting wet vapor to the said conical part 12 of the said mixing chamber of the said thermocompressor 10, driving a load 8 via a connecting shaft, whereby the expansion pressure ratio of the said backpressure steam turbine 1 is chosen to be equal to the pressure recovery ratio of the said wet-vapor thermocompressor 10, which is obtainable at an ejector entrainment ratio (ratio of mass flow rates of suction and driving fluid) defined by the vapor quality at the outlet of the said diffuser 15;

(4) the said load 8, typically an electric generator, converting mechanical energy of the said steam turbine 1 into the generator's electrical energy supplied to the grid;

(5) a condensate pump 3 for pressurizing and circulation of the liquid working fluid (saturated water) separated in the said cylindrical separation tank 2;

(6) a stop valve 4 at the discharge side of the said condensate pump 3 for starting up of the said pump 3 and of the entire working-fluid circulation loop;

(7) a liquid/water heater (heat exchanger) 5 for isobaric heat addition to the liquid working fluid, typically subcooled water or a low-quality water-vapor mixture, either directly heated by any fuel or indirectly heated by heat exchange with any source of heat contained in a primary heat-exchange fluid, thereby supplying the heated liquid working fluid to the said nozzle 11 of the said thermocompressor 10, to the end of re-pressurizing of the secondary ejector fluid (exhausted wet vapor from the said backpressure steam turbine 1).

Figure 3:
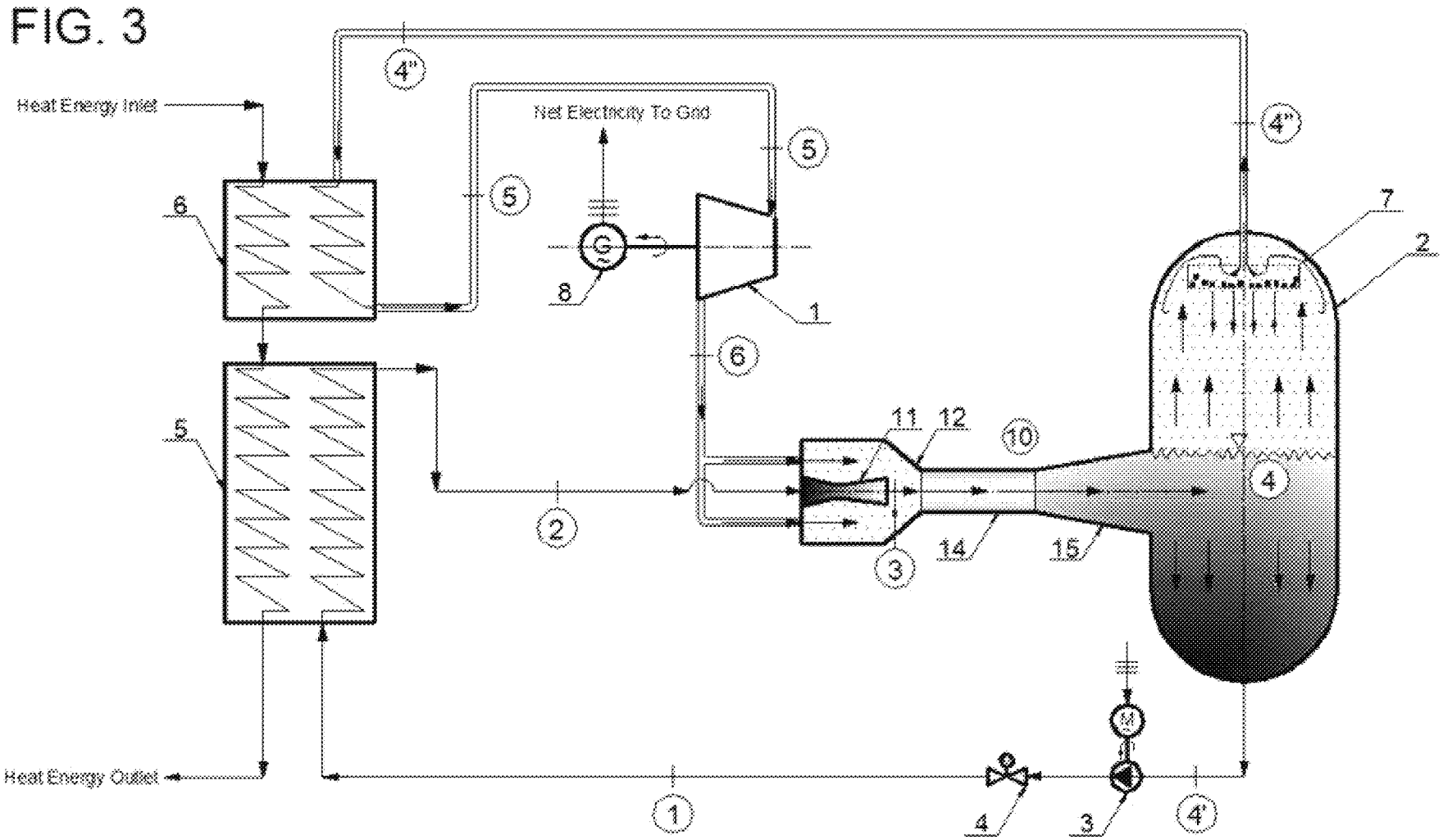
FIG. 3 depicts a flow diagram of an alternative indirectly-heated modified Rankine-cycle power-plant driven by a wet-vapor-region thermocompressor using a superheated backpressure steam turbine.

FIG. 3 depicts a flow diagram of an alternative configuration of the modified Rankine-cycle power-plant without cycle-heat rejection and driven by a wet-vapor-region thermocompressor depicted in FIG. 1, with a solely difference being the use of an additional heat exchanger/superheater 6 for isobaric heat addition to the saturated vapor (gas fraction) separated in the said cylindrical separation tank 2, to the end superheating of the saturated vapor and thus enabling the said backpressure steam turbine 1 to operate with superheated steam at its inlet, resulting in an increased steam-turbine specific work for the same expansion pressure ratio.

Figure 5:
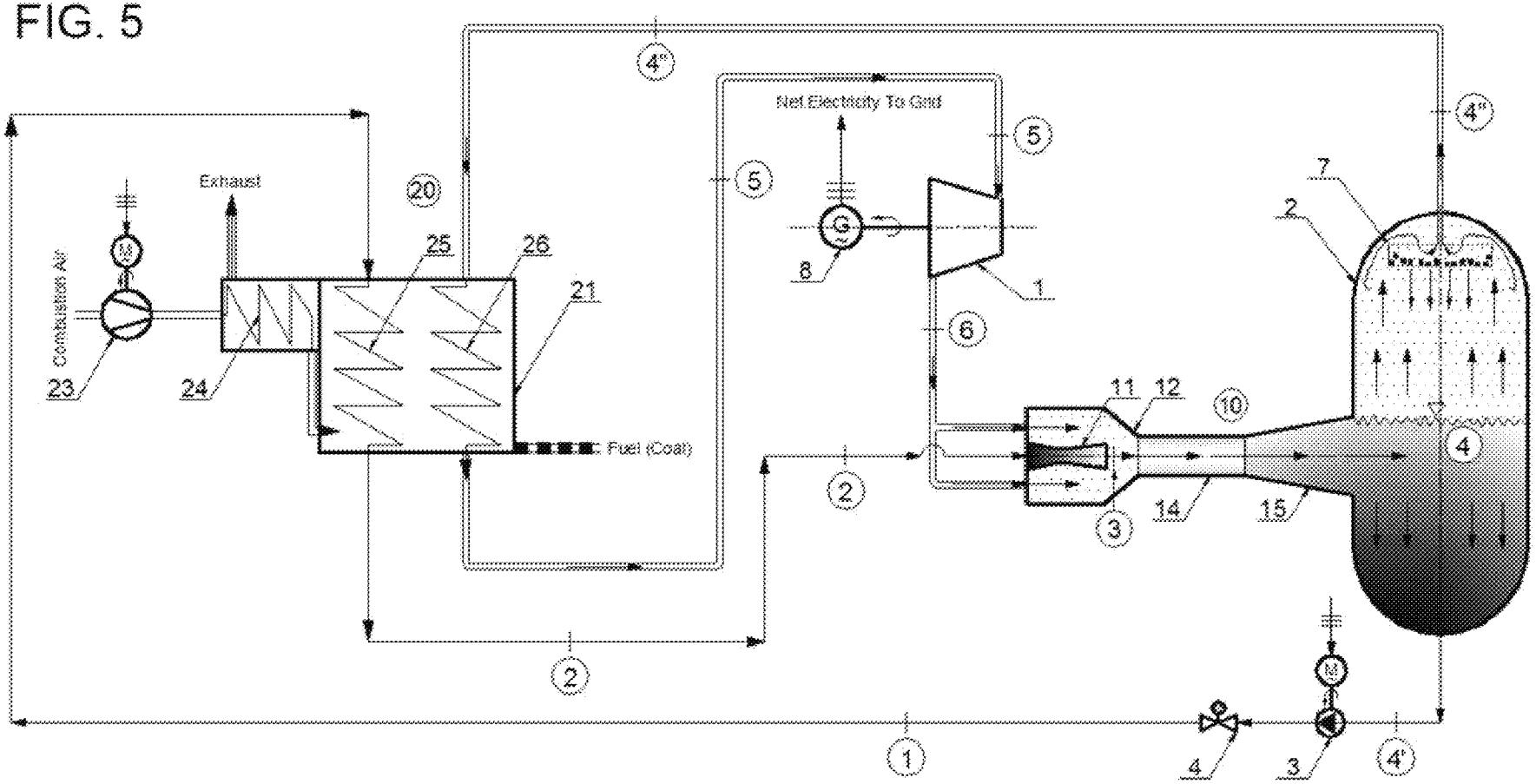
FIG. 5 depicts a flow diagram of an externally-fired (by coal or solid/liquid waste fuel) directly-heated version of the modified Rankine-cycle power-plant configuration driven by a wet-vapor-region thermocompressor depicted in FIG. 3.

FIG. 5 depicts a flow diagram of an externally-fired (by coal, solid/liquid waste fuel or biomass) directly-heated version of the configuration of the modified Rankine-cycle power-plant without cycle-heat rejection and driven by a wet-vapor-region thermocompressor depicted in FIG. 3, whereas the said liquid/water heater 5 and the said superheater 6 are incorporated in the form of multi-tube bundles 25 and 26, respectively, within an integral water/steam heater 20, which in addition contains also a furnace refractory 21, a forced-draft fan 23 for combustion-air circulation, and a regenerative combustion-air preheater 24.

Figure 6:
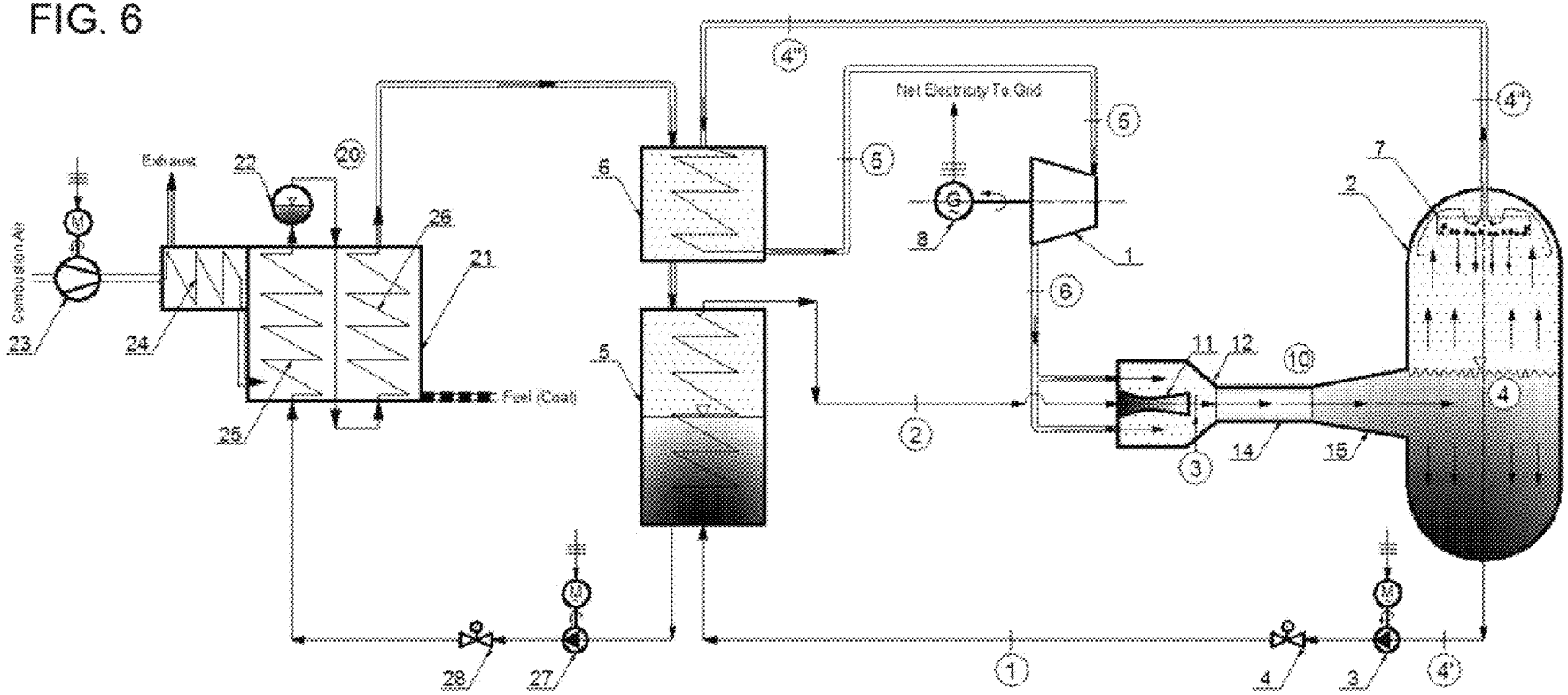
FIG. 6 depicts a flow diagram of an externally-fired (by coal or solid/liquid waste fuel) indirectly-heated version of the modified Rankine-cycle power-plant configuration driven by a wet-vapor-region thermocompressor depicted in FIG. 3.

Similarly, flow diagram depicted in FIG. 6 shows an almost identical alternative externally-fired indirectly-heated version of the configuration of the modified Rankine-cycle power-plant without cycle-heat rejection and driven by a wet-vapor-region thermocompressor depicted in FIG. 5, whereas the cycle heat is added indirectly to the said liquid/water heater 5 and the said superheater 6, by means of a primary heat-exchange fluid (typically water-steam) circulating in a separate primary-fluid loop, which contains the said integral water/steam heater 20 with all the above mentioned components, incorporating also: an additional steam drum 22 for separation of liquid (typically saturated water) and gas (typically saturated vapor) phases within the said integral water/steam heater 20, a condensate/feedwater pump 27 for the primary-heat-exchange-fluid pressurization and circulation and a stop valve 28 at the discharge side of the said primary-heat-exchange-fluid pump 27 for starting up of the said pump 27 and of the entire primary-fluid circulation loop.

Figure 7:
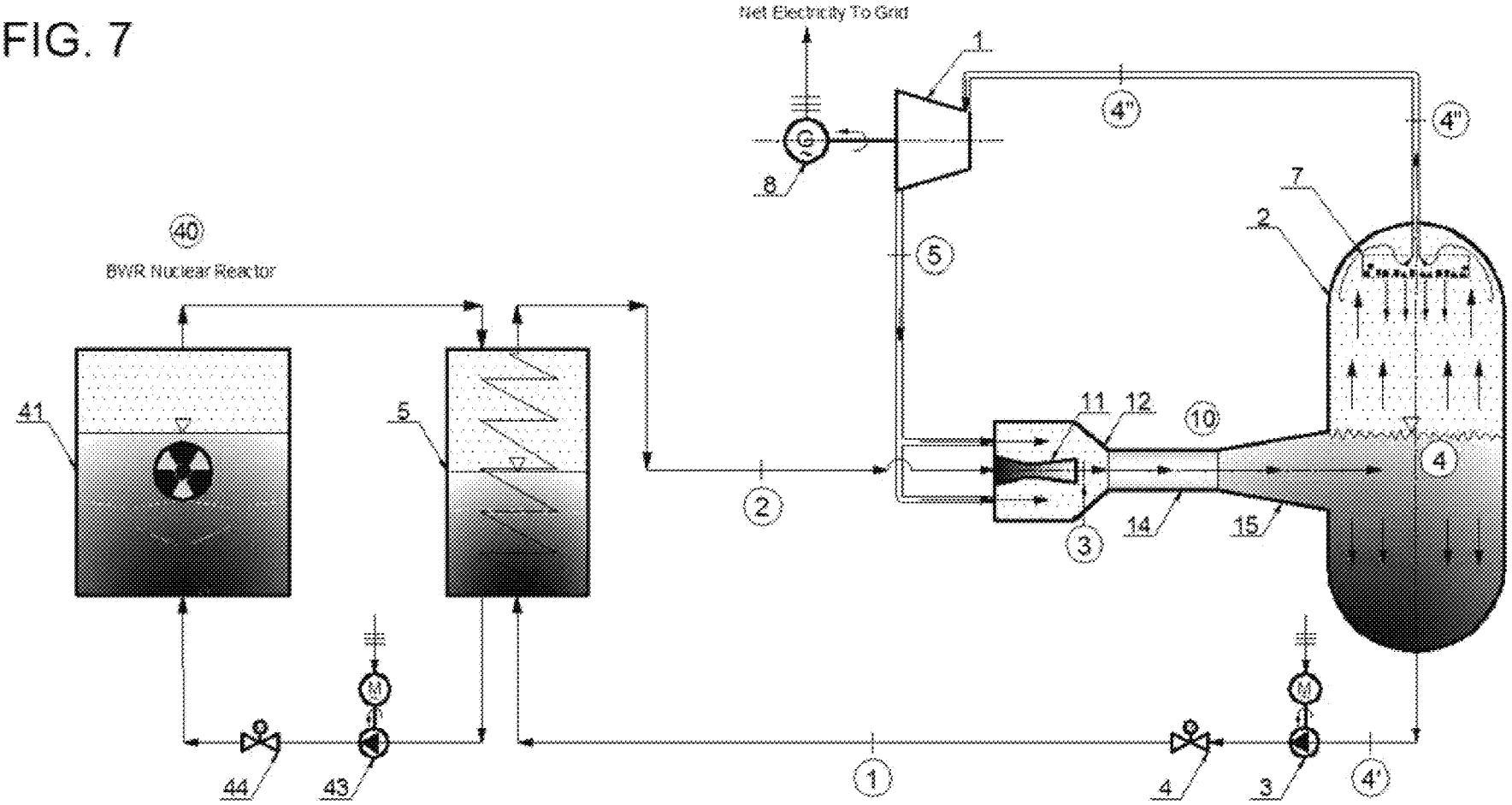
FIG. 7 depicts a flow diagram of an indirectly-heated version of the modified Rankine-cycle power-plant configuration driven by a wet-vapor-region thermocompressor depicted in FIG. 1, fueled by nuclear fuel using a boiling water reactor (BWR).

FIG. 7 depicts a flow diagram of an indirectly-heated version of the modified Rankine-cycle power-plant configuration without cycle-heat rejection and driven by a wet-vapor-region thermocompressor depicted in FIG. 1, which uses a boiling water reactor (BWR) 40 fueled by nuclear fuel as a heat source transferring the nuclear-reactor heat to the said liquid/water heater 5, whereas the reactor primary-coolant circuit contains also: a primary-coolant circulation pump 43 for the primary-coolant-fluid pressurization and circulation and a stop valve 44 at the discharge side of the said primary-coolant pump 43 for starting up of the said pump 43 and of the entire primary-coolant circuit.

Figure 8:
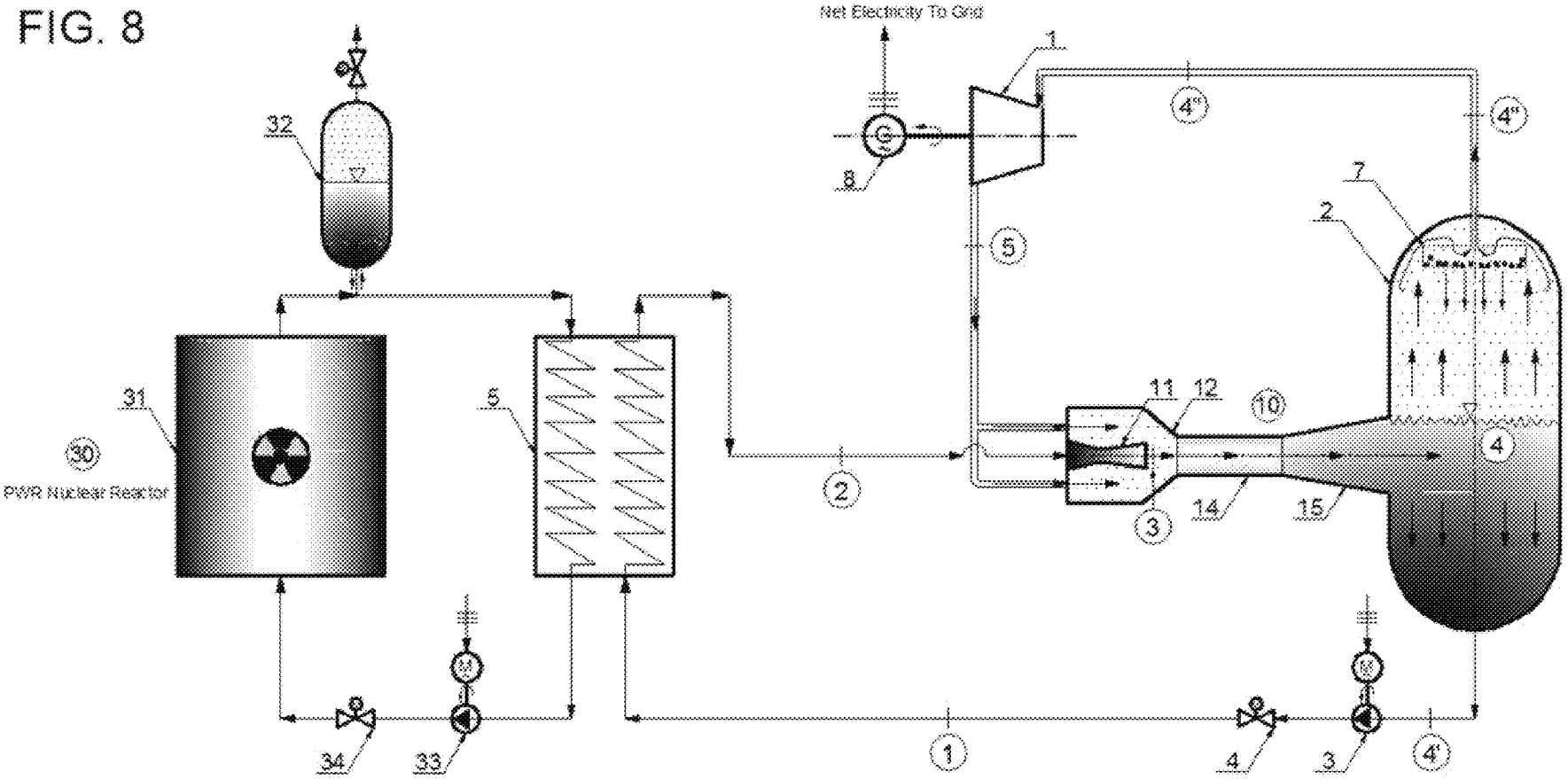
FIG. 8 depicts a flow diagram of an indirectly-heated version of the modified Rankine-cycle power-plant configuration driven by a wet-vapor-region thermocompressor depicted in FIG. 1, fueled by nuclear fuel using a pressurized water reactor (PWR).

Similarly, FIG. 8 depicts a flow diagram of an indirectly-heated version of the modified Rankine-cycle power-plant configuration without cycle-heat rejection and driven by a wet-vapor-region thermocompressor depicted in FIG. 1, which uses a pressurized water reactor (PWR) 30 fueled by nuclear fuel as a heat source transferring the nuclear-reactor heat to the said liquid/water heater 5, whereas the reactor primary-coolant circuit contains also: a pressurizer 32 for maintaining of the primary-circuit pressure, a primary-coolant circulation pump 33 for the primary-coolant-fluid pressurization and circulation and a stop valve 34 at the discharge side of the said primary-coolant pump 33 for starting up of the said pump 33 and of the entire primary-coolant circuit.

Figure 9:
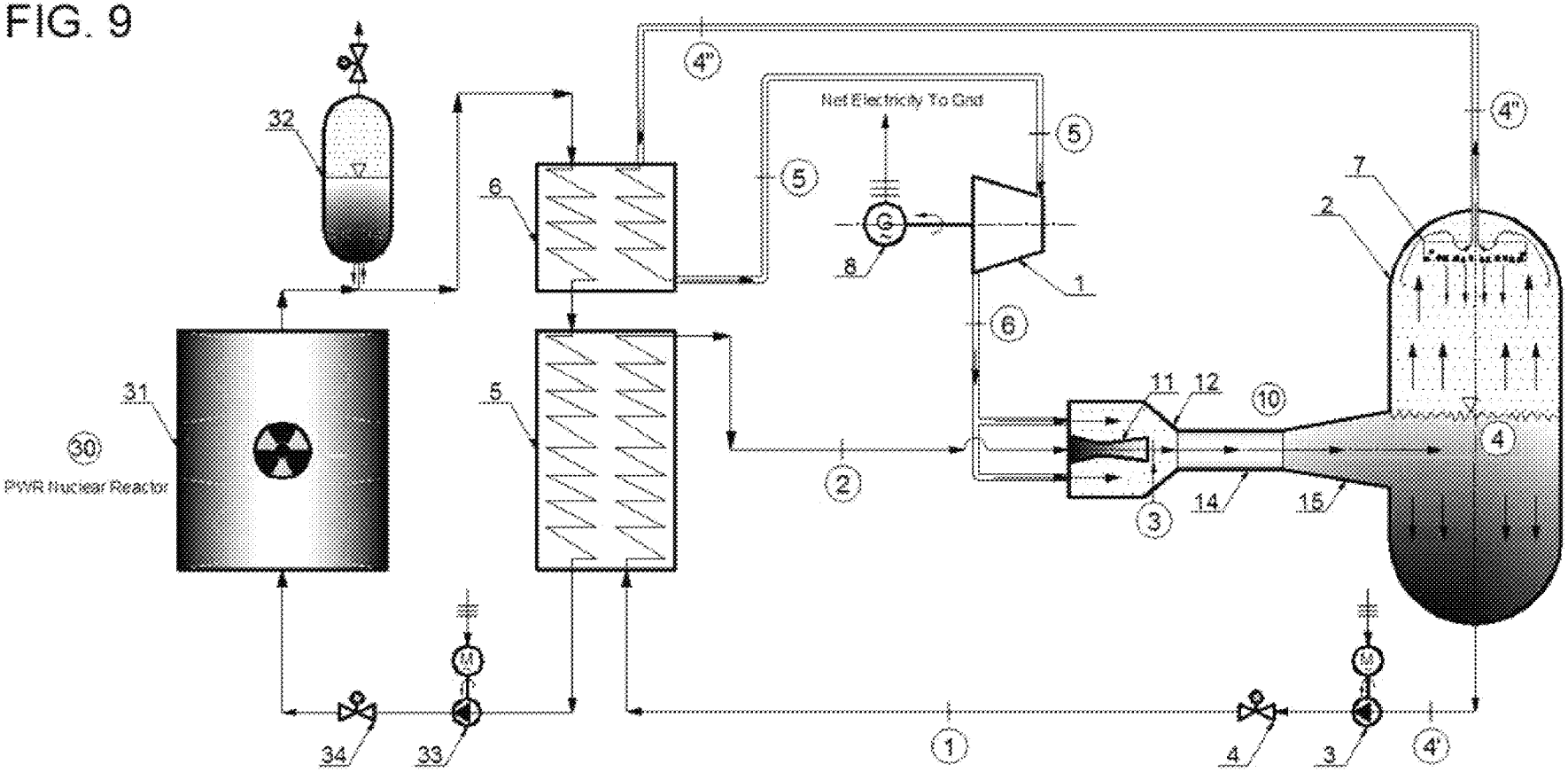
FIG. 9 depicts a flow diagram of an indirectly-heated version of the modified Rankine-cycle power-plant configuration driven by a wet-vapor-region thermocompressor depicted in FIG. 3, fueled by nuclear fuel using a pressurized water reactor (PWR).

FIG. 9 depicts a flow diagram of an alternative indirectly-heated version of the modified Rankine-cycle power-plant without cycle-heat rejection and driven by a wet-vapor-region thermocompressor depicted in FIG. 8, powered by a pressurized-water-reactor (PWR) 30, with a solely difference being the use of the said additional heat exchanger/superheater 6 for isobaric heat addition to the saturated vapor (gas fraction) separated in the said cylindrical separation tank 2, to the end superheating of the saturated vapor and thus enabling the said backpressure steam turbine 1 to operate with superheated steam at its inlet, resulting in an increased steam-turbine specific work for the same expansion pressure ratio.

Figure 10:
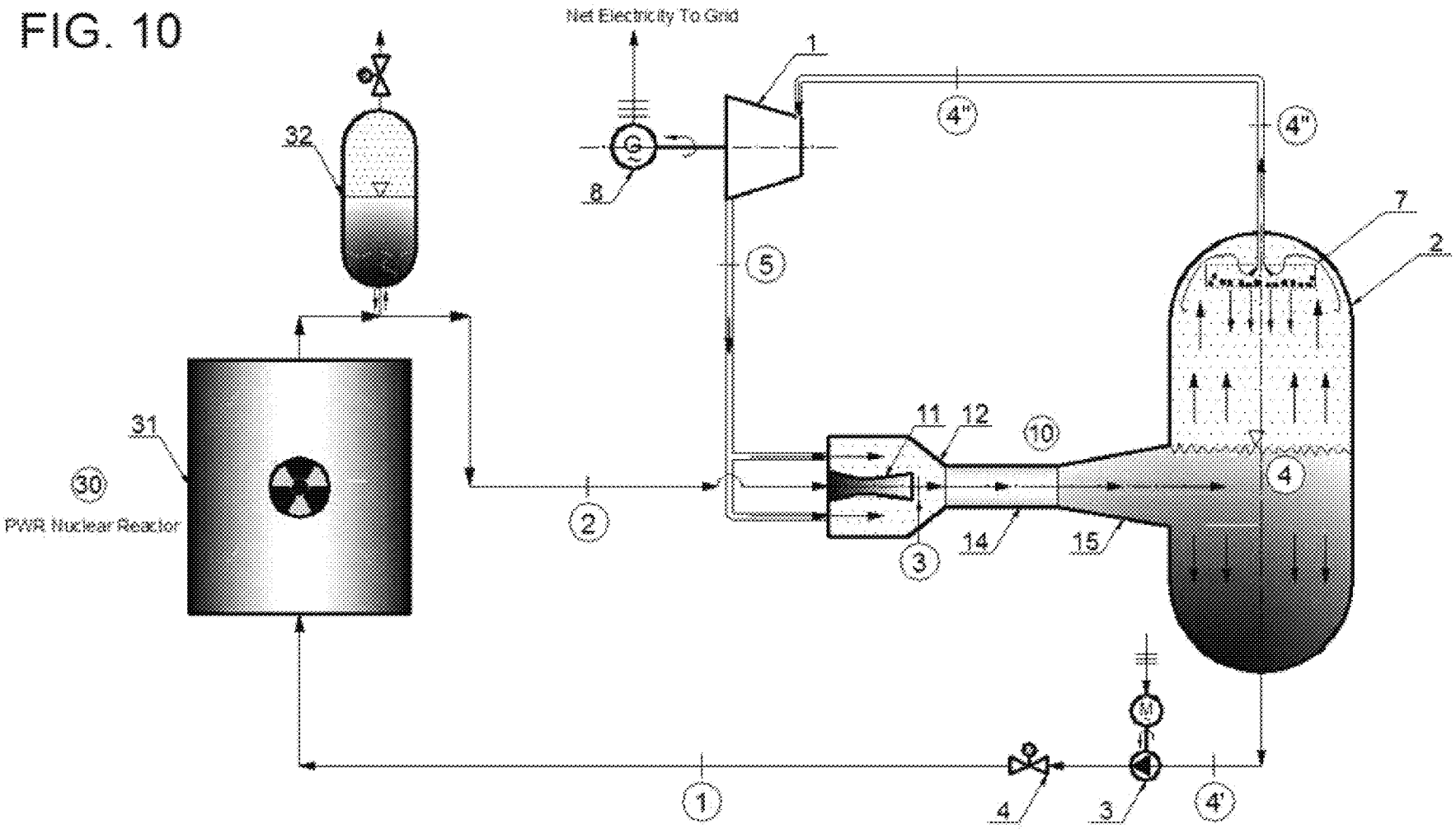
FIG. 10 depicts a flow diagram of a directly-heated version of the modified Rankine-cycle power-plant configuration driven by a wet-vapor-region thermocompressor depicted in FIG. 1, fueled by nuclear fuel using a pressurized water reactor (PWR).

FIG. 10 depicts a flow diagram of an alternative directly-heated version of the modified Rankine-cycle power-plant without cycle-heat rejection and driven by a wet-vapor-region thermocompressor depicted in FIG. 8, powered by a pressurized-water-reactor (PWR) 30, whereas the said liquid/water heater 5 is omitted from the cycle configuration and the reactor coolant (pressurized light water) from the reactor-vessel outlet is used directly as the primary (driving) ejector fluid supplying the said nozzle 11 of the said thermocompressor 10, to the end of re-pressurizing of the secondary ejector fluid (exhausted wet vapor from the said backpressure turbine 1).

Figure 11:
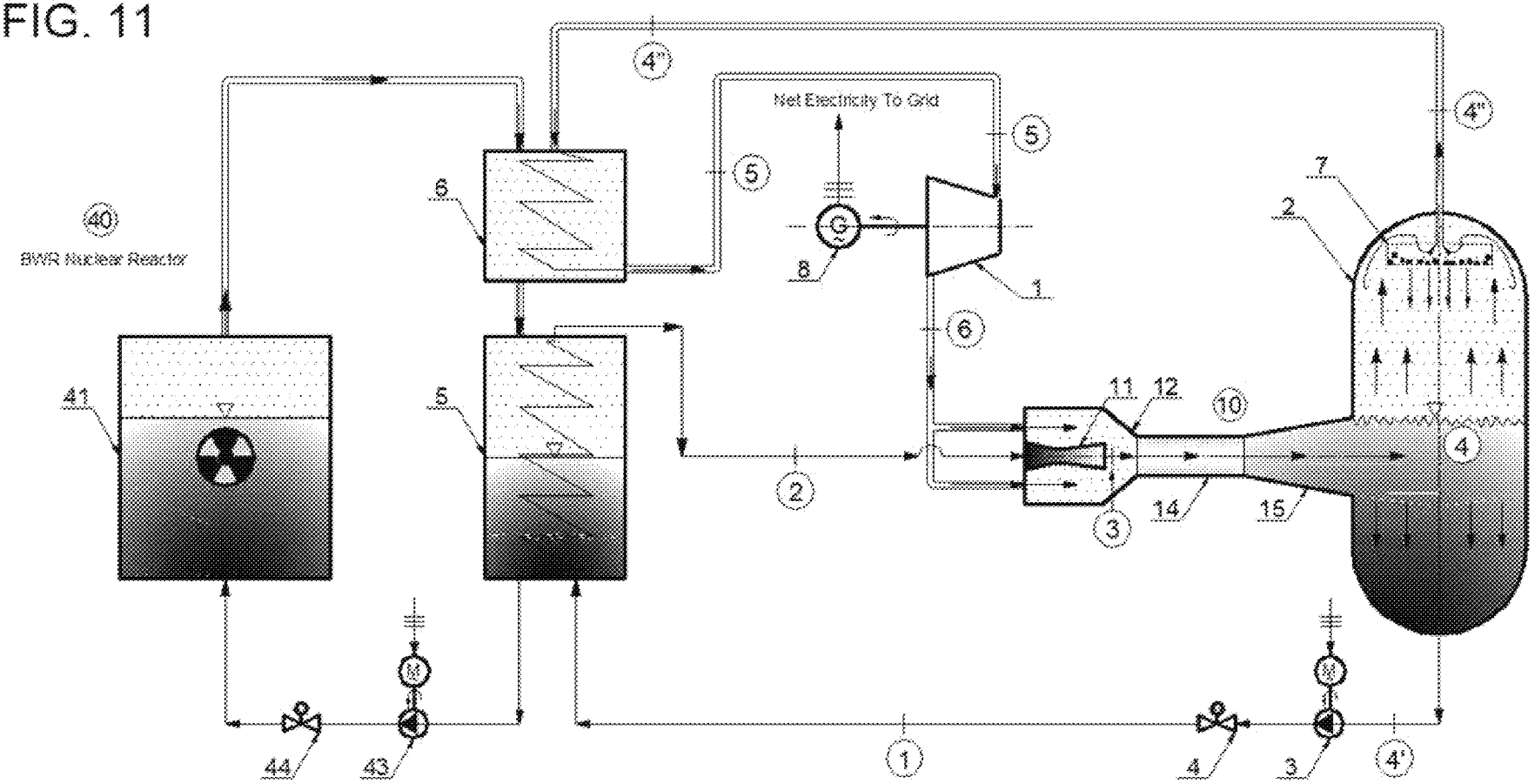
FIG. 11 depicts a flow diagram of an indirectly-heated version of the modified Rankine-cycle power-plant configuration driven by a wet-vapor-region thermocompressor depicted in FIG. 3, fueled by nuclear fuel using a boiling water reactor (BWR).

Similarly, FIG. 11 depicts a flow diagram of an alternative indirectly-heated version of the modified Rankine-cycle power-plant without cycle-heat rejection and driven by a wet-vapor-region thermocompressor depicted in FIG. 7, powered by a boiling-water-reactor (BWR) 40, with a solely difference being the use of the said additional heat exchanger/superheater 6 for isobaric heat addition to the saturated vapor (gas fraction) separated in the said cylindrical separation tank 2, to the end superheating of the saturated vapor and thus enabling the said backpressure steam turbine 1 to operate with superheated steam at its inlet, resulting in an increased steam-turbine specific work for the same expansion pressure ratio.

Figure 12:
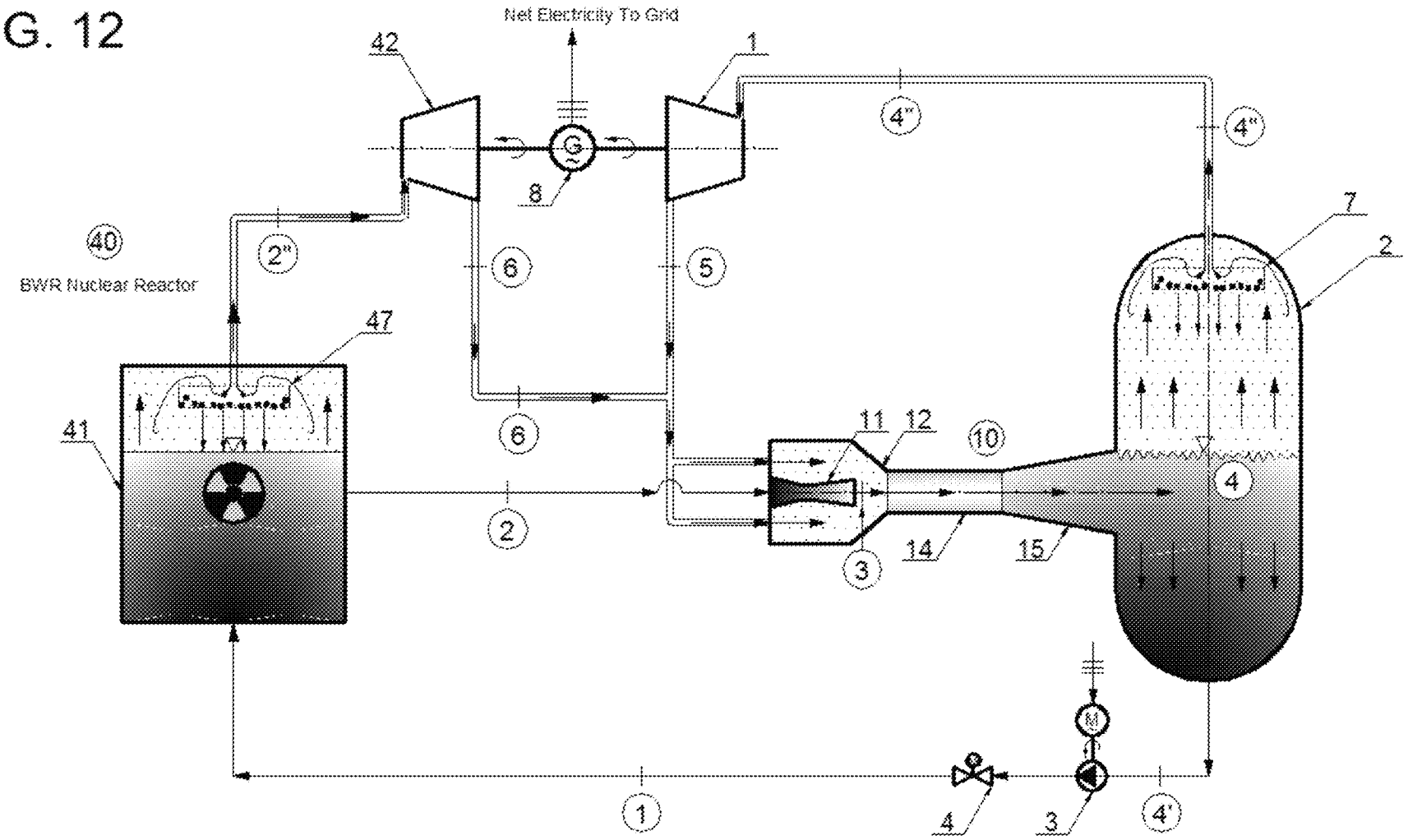
FIG. 12 depicts a flow diagram of a directly-heated version of the modified Rankine-cycle power-plant configuration driven by a wet-vapor-region thermocompressor depicted in FIG. 1, fueled by nuclear fuel using a boiling water reactor (BWR).

FIG. 12 depicts a flow diagram of an alternative directly-heated version of the modified Rankine-cycle power-plant without cycle-heat rejection and driven by a wet-vapor-region thermocompressor depicted in FIG. 7, powered by a boiling-water-reactor (BWR) 40, whereas the said liquid/water heater 5 is omitted from the cycle configuration and a part of the liquid reactor coolant (saturated light water) from the reactor-vessel outlet is used directly as the primary (driving) ejector fluid supplying the said nozzle 11 of the said thermocompressor 10, to the end of re-pressurizing of the secondary ejector fluid, which in this case is a mixture of exhausted wet vapor from both the said backpressure turbine 1 and an additional backpressure steam turbine 42, supplied by the gaseous part of the reactor coolant (saturated light-water vapor) to produce additional turbine work and installed on the same shaft with the said steam turbine 1 to drive the said load 8.

Figure 13:
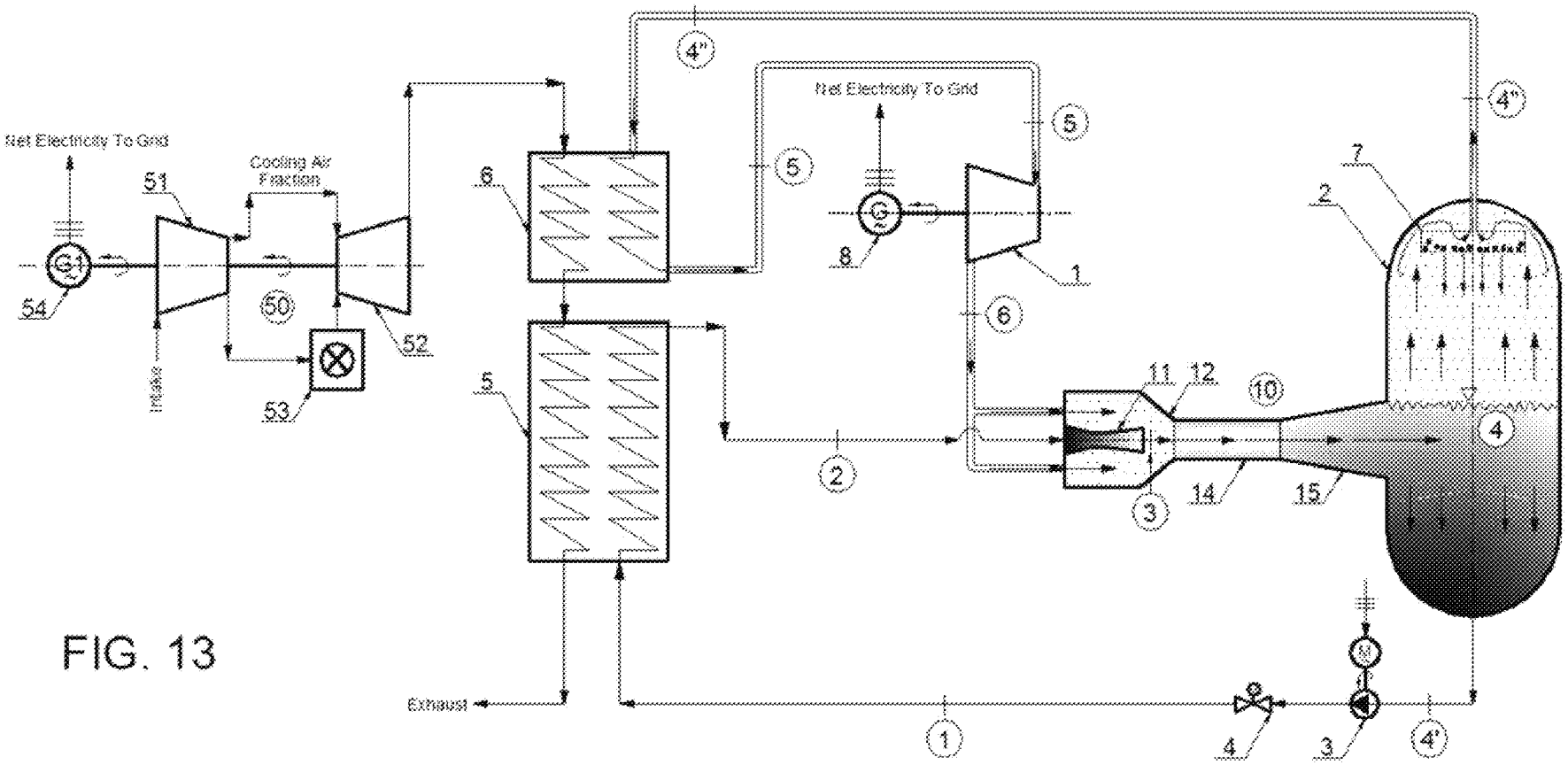
FIG. 13 depicts a flow diagram of an indirectly-heated version of the modified Rankine-cycle power-plant configuration driven by a wet-vapor-region thermocompressor depicted in FIG. 3 as the bottoming steam-cycle part of a natural-gas-fired combined cycle (NGCC).

FIG. 13 depicts a flow diagram of an indirectly-heated version of the modified Rankine-cycle power-plant configuration without cycle-heat rejection and driven by a wet-vapor-region thermocompressor depicted in FIG. 3, which is in this case used as the bottoming steam-cycle part of a natural-gas-fired combined cycle (NGCC) 50 powered by the NGCC waste heat, whereas the NGCC typically consists of the following main components: an air compressor 51 for sucking and compressing the ambient air, a combustion chamber/combustor 52 for cycle heat addition, a gas turbine 53 for expansion of the combustion gas, and an additional load 54, typically another electric generator.

Figure 14:
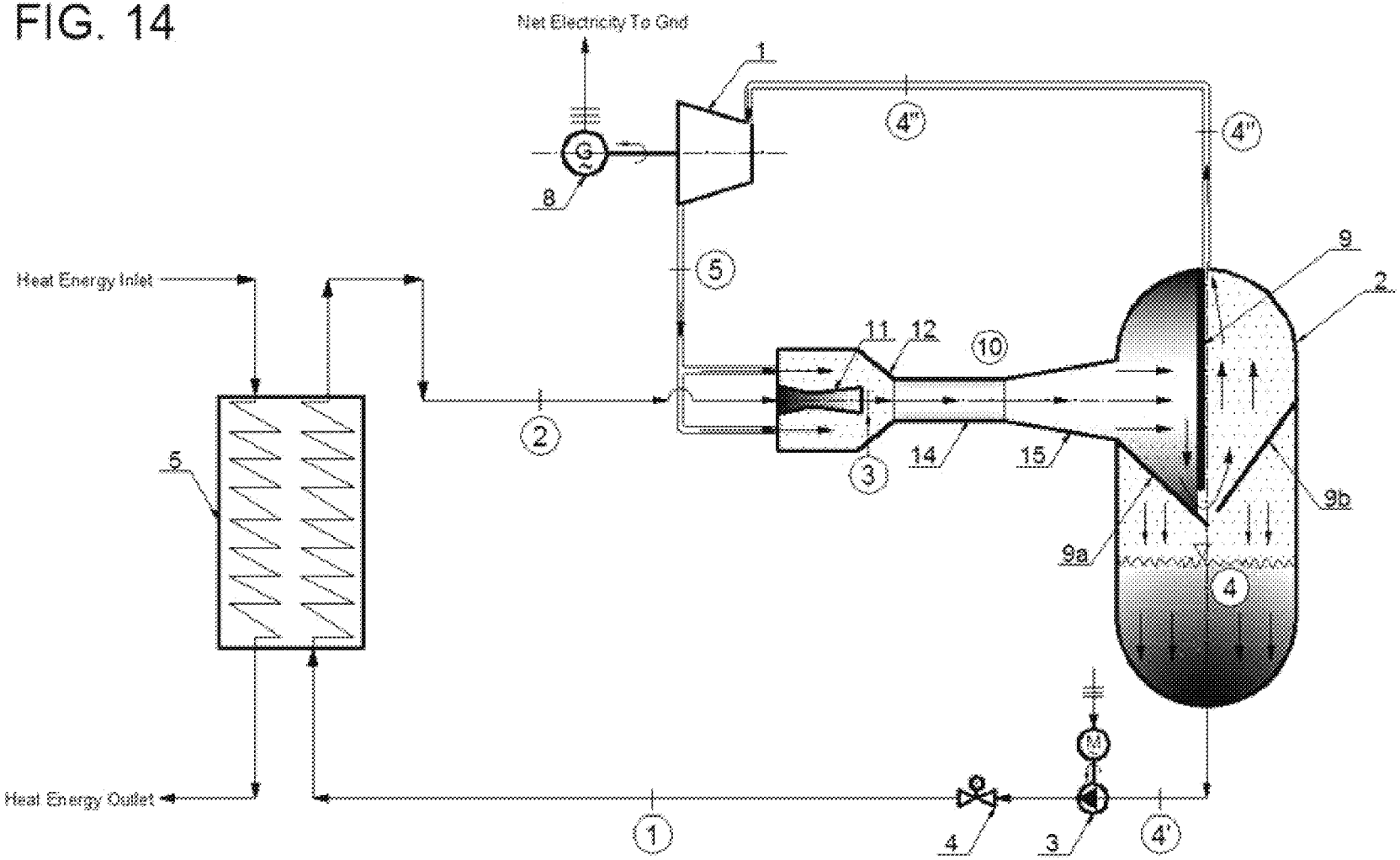
FIG. 14 and FIG. 15 depict flow diagrams of indirectly-heated versions of the modified Rankine-cycle power-plant configurations driven by a wet-vapor-region thermocompressor depicted in FIG. 1 and FIG. 3, respectively, using a different method of the steam/vapor separation.
Figure 15:
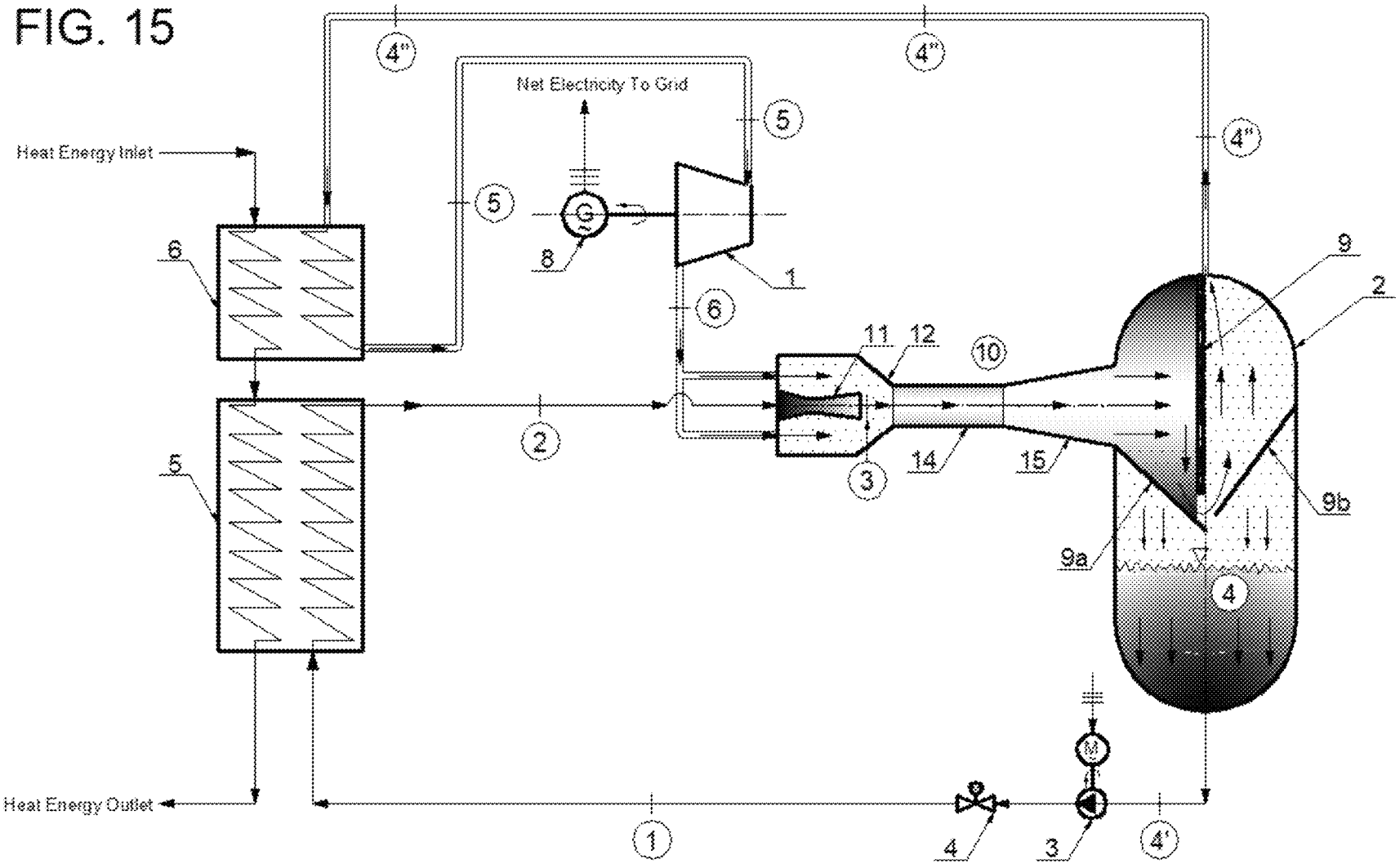

FIG. 14 and FIG. 15 depict flow diagrams of indirectly-heated versions of the modified Rankine-cycle power-plant configurations without cycle-heat rejection and driven by a wet-vapor-region thermocompressor depicted in FIG. 1 and FIG. 3, respectively, with a solely difference being the use of a baffle-plate steam separator having the said cylindrical separation tank 2 fitted with three (3) baffle plates 9, 9*a* and 9*b*, which serve to change the direction of the incoming steam flow when the steam strikes the baffle plates, prompting heavier water particles contained in the steam-water mixture to fall down to the bottom of the separation tank, while the separated steam is freed from water particles and passed to the said backpressure steam turbine 1.

Figure 16:
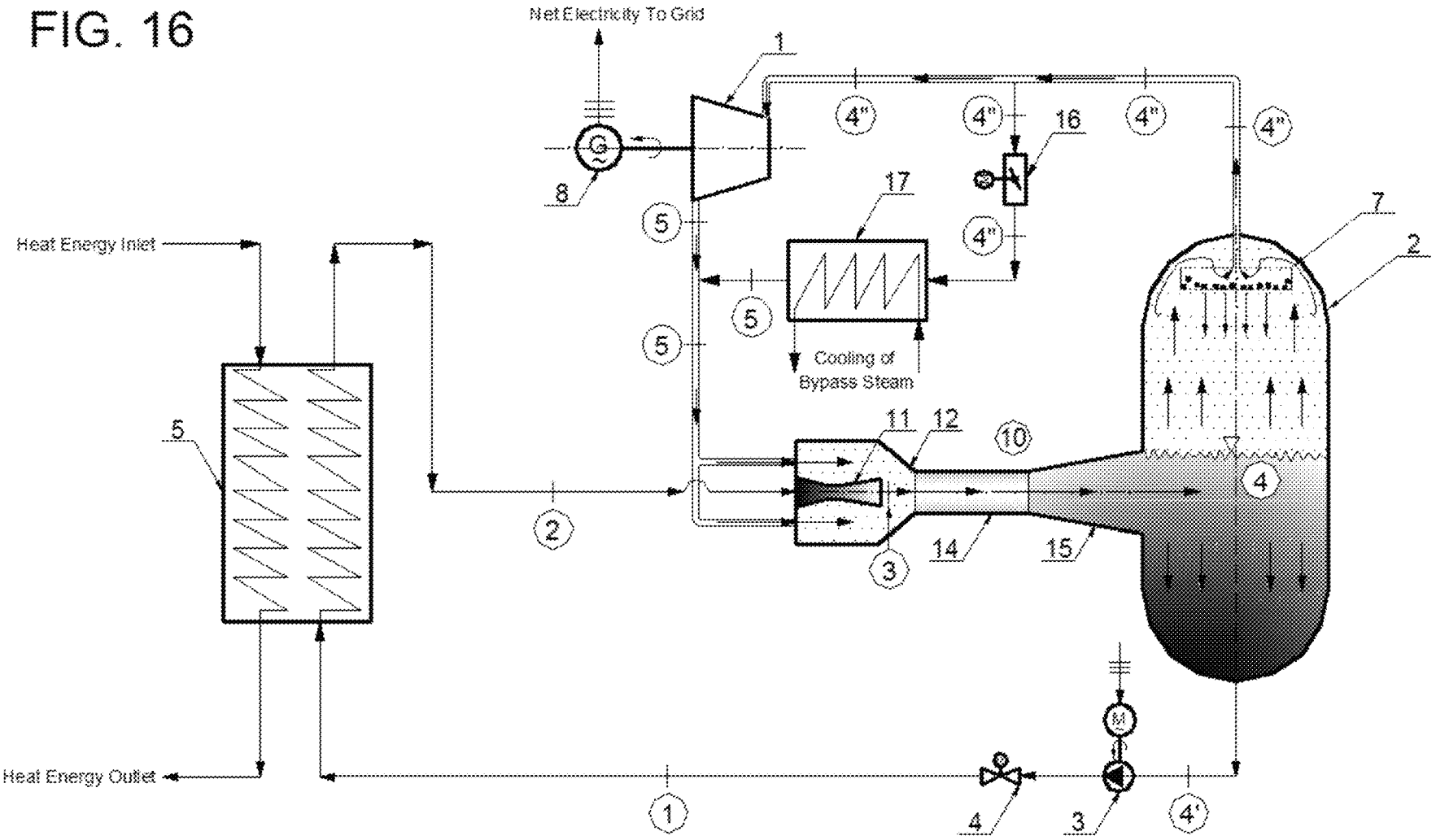
FIG. 16 and FIG. 17 depict flow diagrams of indirectly-heated versions of the modified Rankine-cycle power-plant configurations driven by a wet-vapor-region thermocompressor depicted in FIG. 1 and FIG. 3, respectively, using quantitative regulation of the cycle output by means of a steam-turbine bypass.
Figure 17:
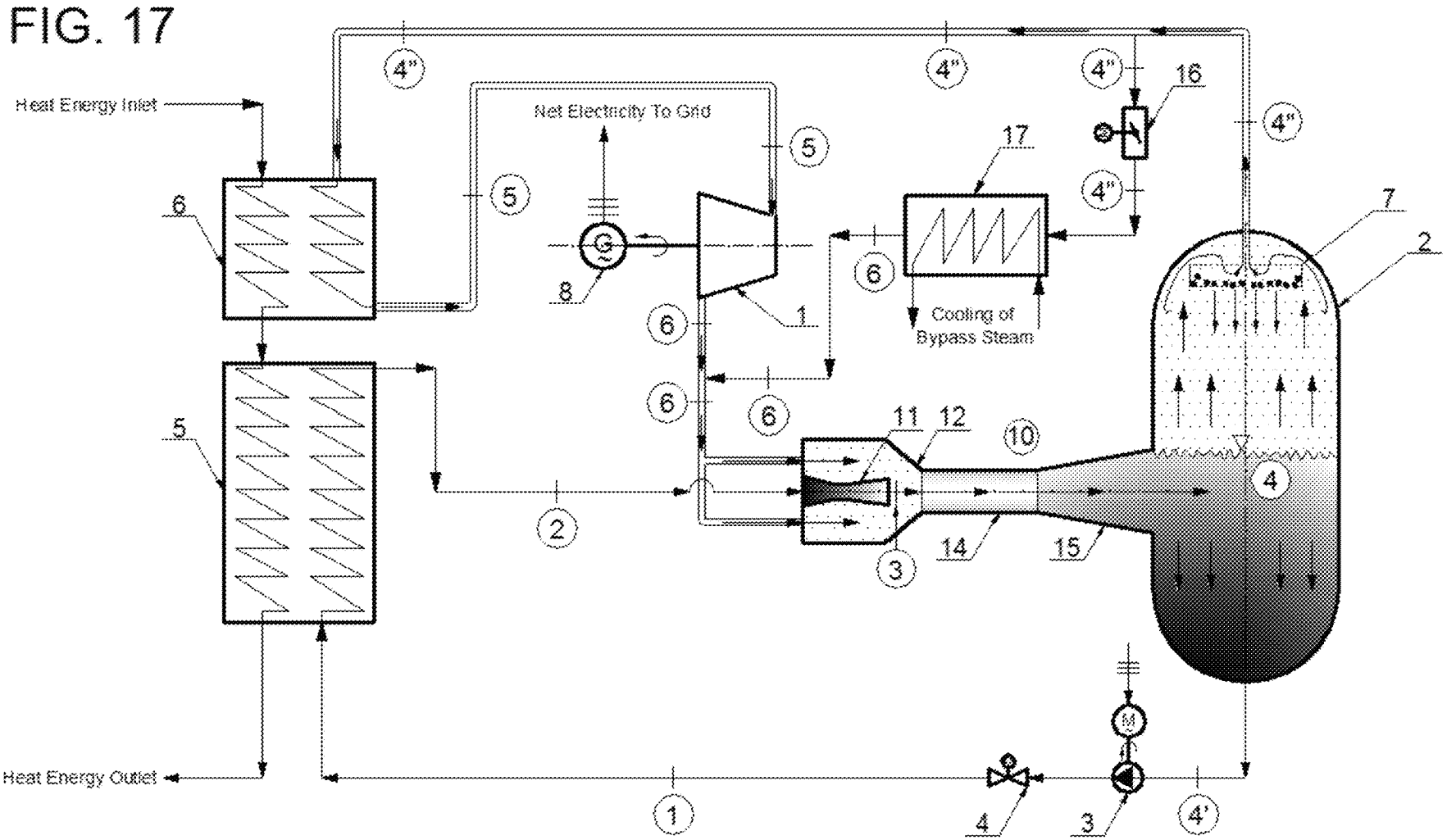

FIG. 16 and FIG. 17 depict flow diagrams of indirectly-heated versions of the modified Rankine-cycle power-plant configurations without cycle-heat rejection and driven by a wet-vapor-region thermocompressor depicted in FIG. 1 and FIG. 3, respectively, with a solely difference being the use of quantitative regulation of the cycle output/load by alteration of the steam-turbine mass flow rate using bypassing of the said backpressure steam turbine 1 via a bypass valve 16 and a subsequent external cooling of the corresponding portion of the steam-turbine bypass mass flow rate using an external water or air cooler 17, up to the steam-turbine 1 outlet temperature existing in the nominal cycle working regime, thus ensuring that eventually-occurring normal shock wave is preferably located in the mixing-chamber throat of the supersonic wet-vapor mixing ejector and that it is a weak one, occurring in the vicinity of the unity Mach number (1.0), and also a stationary one at a continually maintained steady-state ejector working regime, and hence minimizing potential reduction of the recoverable pressure rise in the thermocompressor/ejector.

Figure 18:
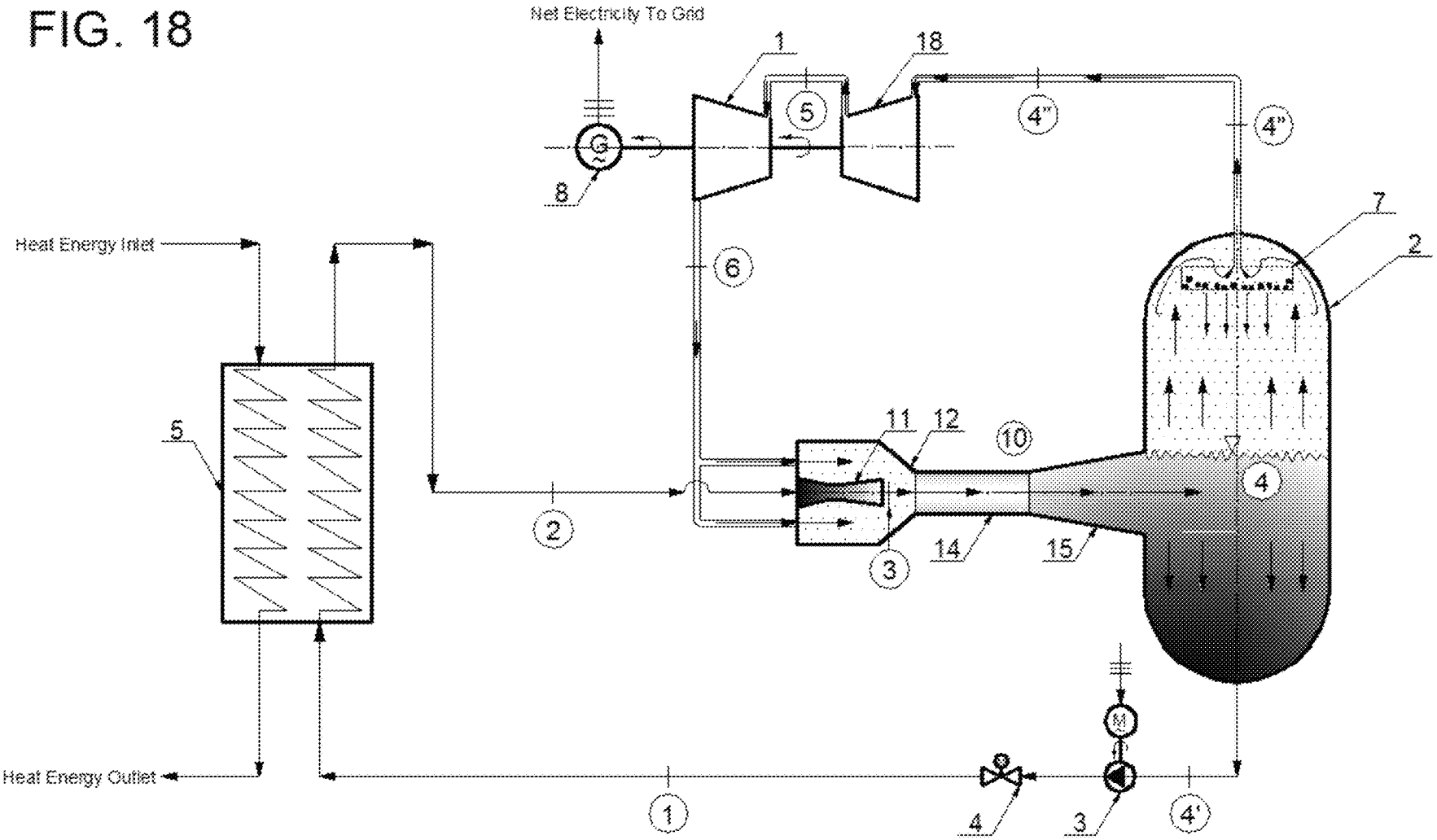
FIG. 18 and FIG. 19 depict flow diagrams of indirectly-heated versions of the modified Rankine-cycle power-plant configurations driven by a wet-vapor-region thermocompressor depicted in FIG. 1 and FIG. 3, respectively, additionally using an optional steam compressor for precompression of the separated steam/vapor prior to its expansion in the steam turbine.
Figure 19:
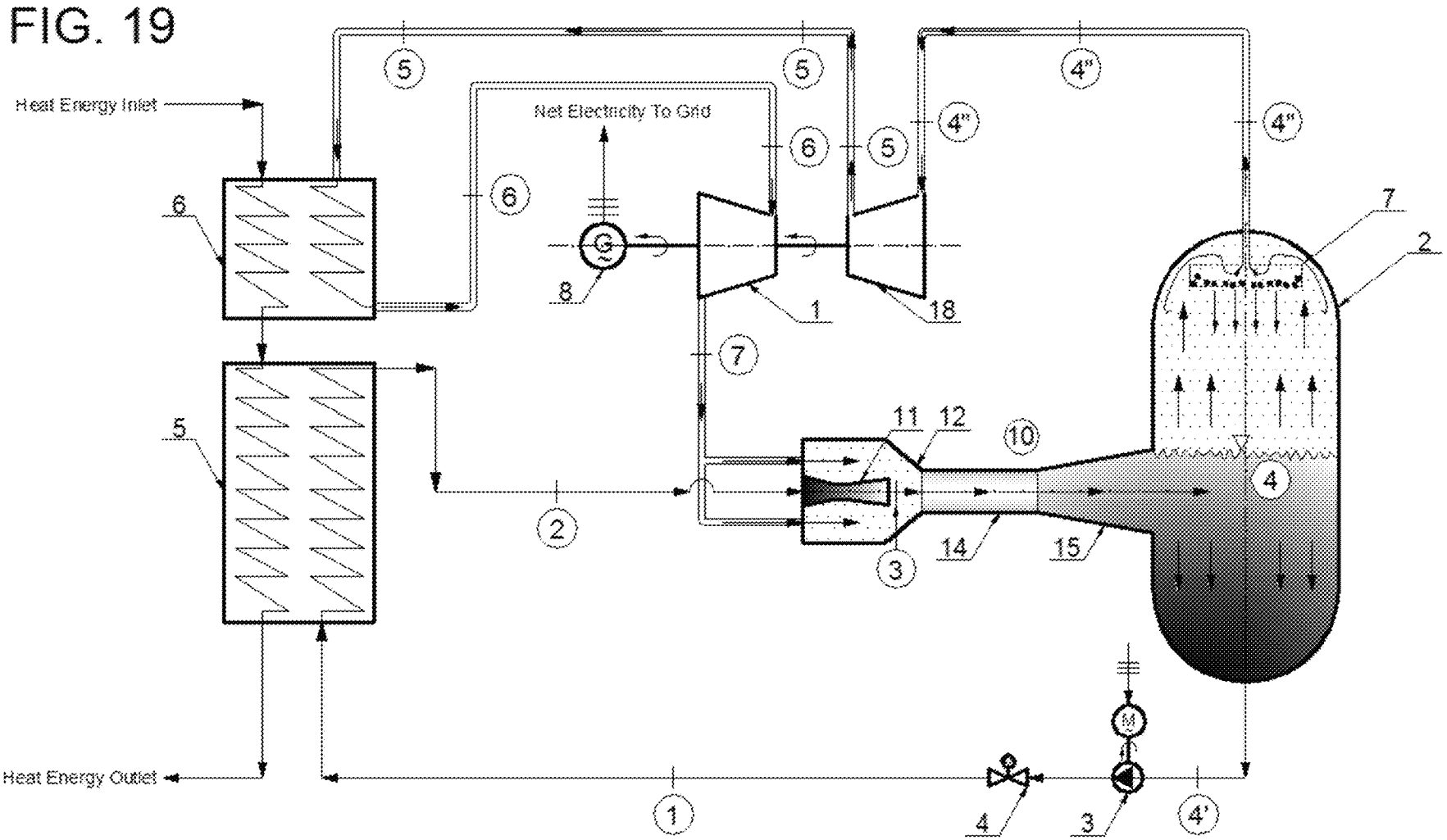

Finally, FIG. 18 and FIG. 19 depict flow diagrams of indirectly-heated versions of the modified Rankine-cycle power-plant configurations driven by a wet-vapor-region thermocompressor depicted in FIG. 1 and FIG. 3, respectively, additionally using an optional steam compressor 18, mounted on the same connecting shaft with the said load 8 and driven by the said backpressure steam turbine 1, for precompression of the secondary ejector fluid (separated saturated steam/vapor) prior to its expansion in the said backpressure steam turbine 1, thus artificially increasing the pressure recovery ratio of the said thermocompressor 10; whereby the said steam compressor 18 in the configuration depicted in FIG. 3 precedes the said additional heat exchanger/superheater 6 of the saturated vapor (the gas fraction separated in the said cylindrical separation tank 2), which itself precedes the said backpressure steam turbine 1.

Figure 20:
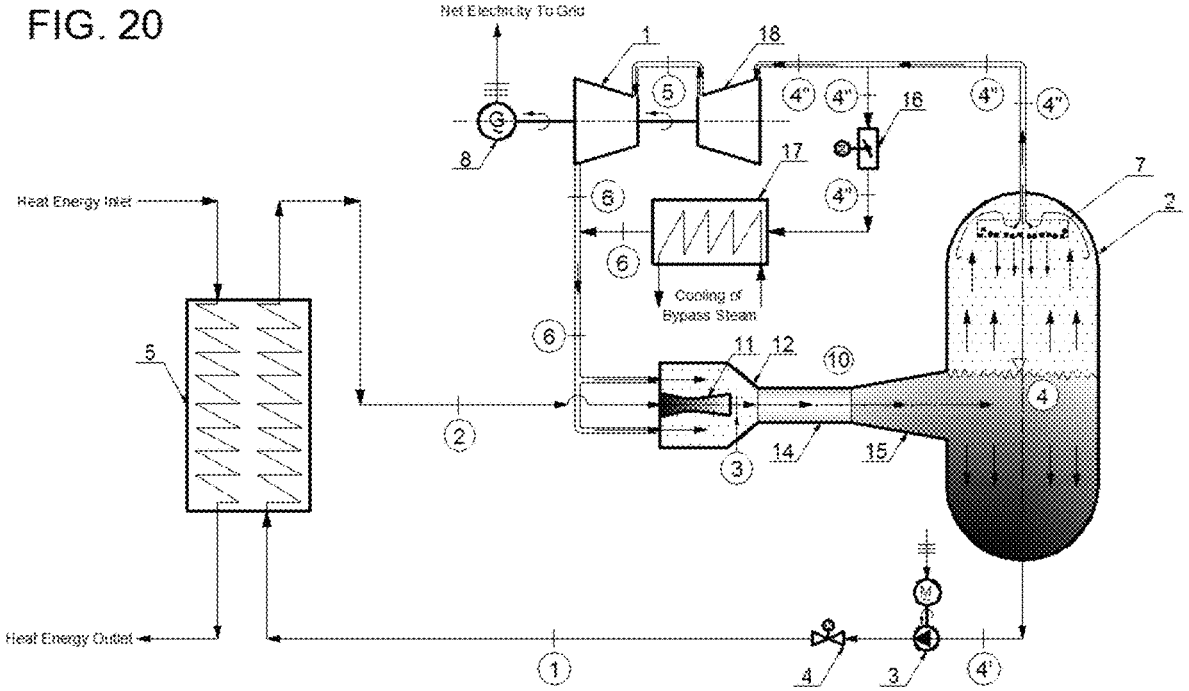
FIGS. 20 and 22 depict flow diagrams of indirectly-heated versions of the modified Rankine-cycle power-plant configurations driven by a wet-vapor-region thermocompressor that use quantitative regulation of the cycle output by means of a steam-turbine bypass, depicted in FIGS. 16 and 17, respectively, additionally using the steam compressor for precompression of the separated steam/vapor prior to its expansion in the steam turbine.
Figure 22:
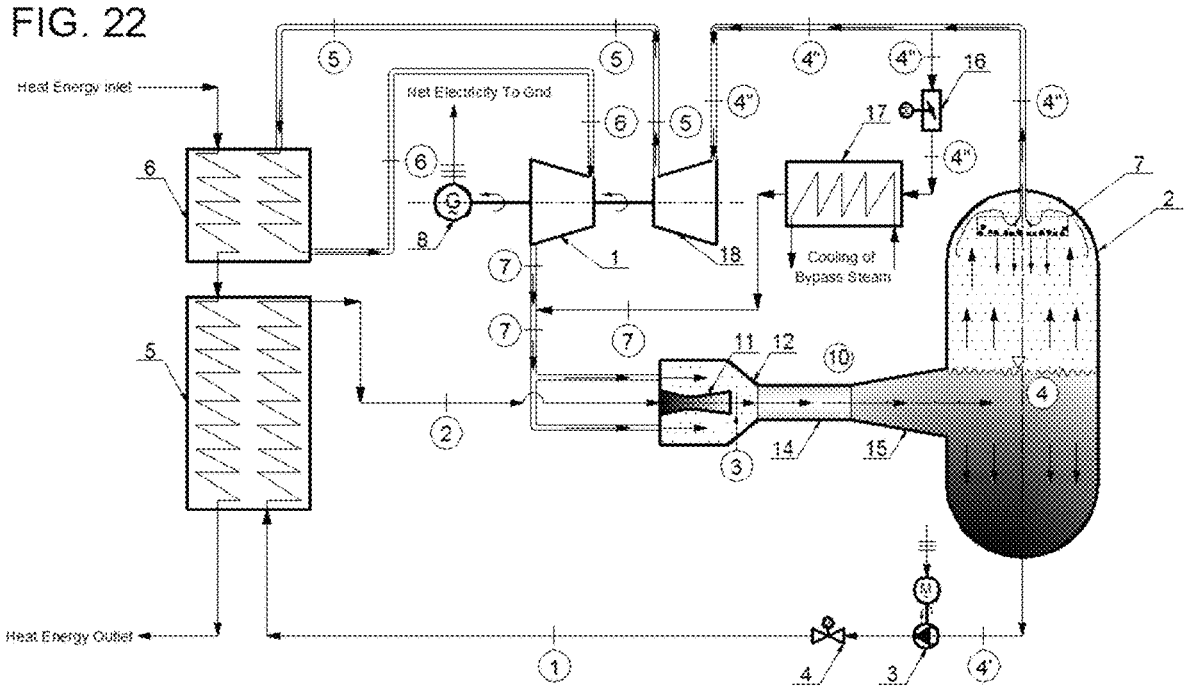

FIGS. 20 and 22 depict flow diagrams of indirectly-heated versions of the modified Rankine-cycle power-plant configurations driven by a wet-vapor-region thermocompressor that use quantitative regulation of the cycle output by means of a steam-turbine bypass, depicted in FIGS. 16 and 17, respectively, additionally using the said steam compressor 18 for precompression of the separated steam/vapor prior to its expansion in the said BP steam turbine 1.

Figure 21:
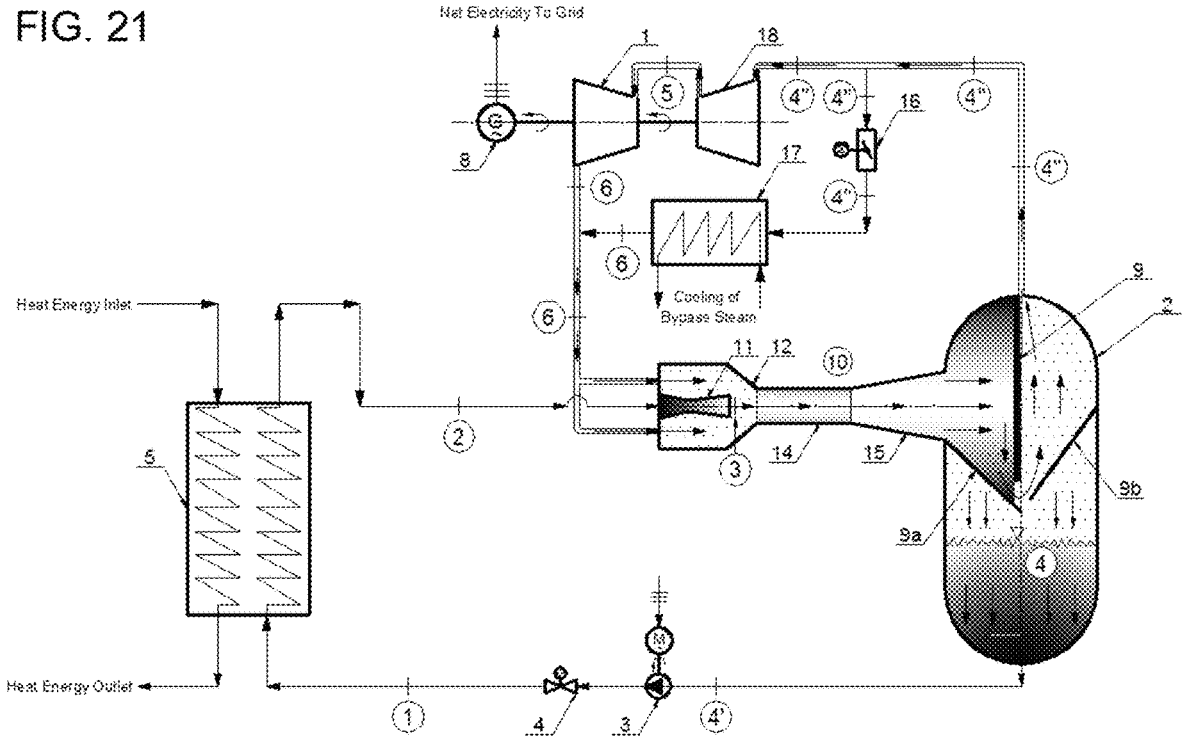
FIGS. 21 and 23 depict flow diagrams of indirectly-heated versions of the modified Rankine-cycle power-plant configurations driven by a wet-vapor-region thermocompressor that use a different method of the steam/vapor separation, depicted in FIGS. 14 and 15, respectively, additionally using quantitative regulation of the cycle output by means of a steam-turbine bypass and the steam compressor for precompression of the separated steam/vapor prior to its expansion in the steam turbine.
Figure 23:
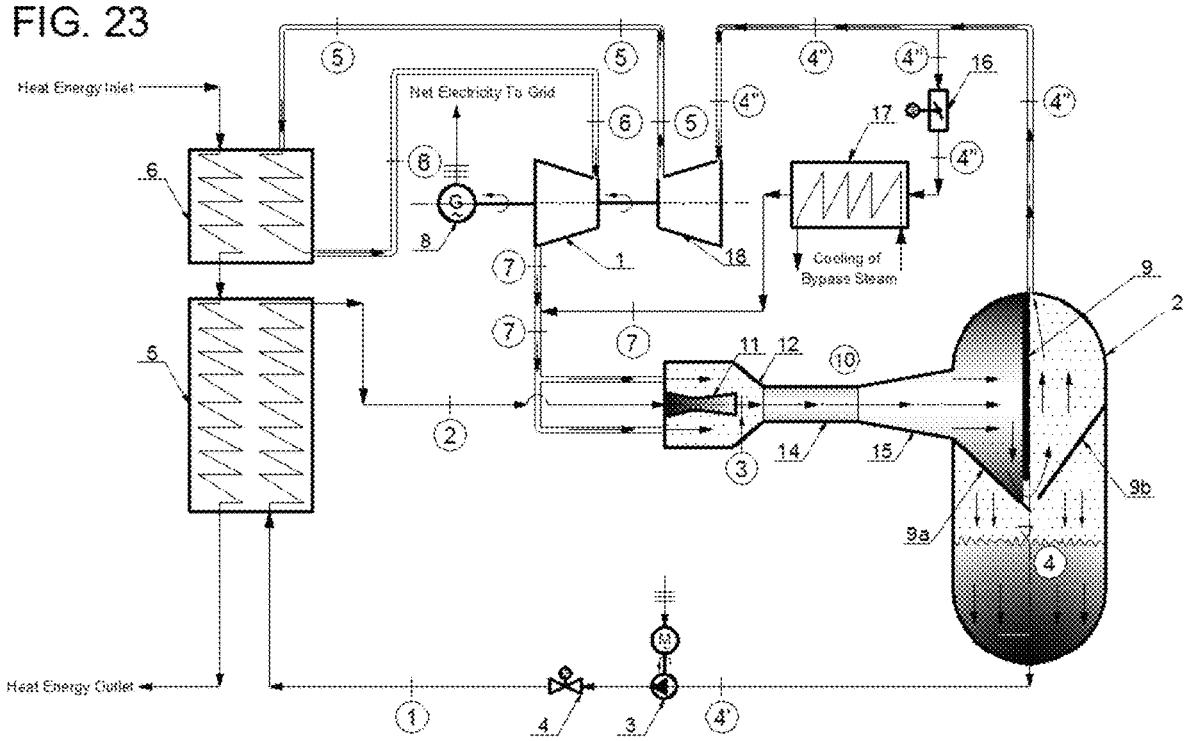

FIGS. 21 and 23 depict flow diagrams of indirectly-heated versions of the modified Rankine-cycle power-plant configurations driven by a wet-vapor-region thermocompressor that use a baffle-plate steam separator for steam/vapor separation, depicted in FIGS. 14 and 15, respectively, additionally using quantitative regulation of the cycle output by means of a steam-turbine bypass and the said steam compressor 18 for precompression of the separated steam/vapor prior to its expansion in the said backpressure steam turbine.

Applied Mathematical Model and Calculation of Exemplary Case #1

Figure 2:
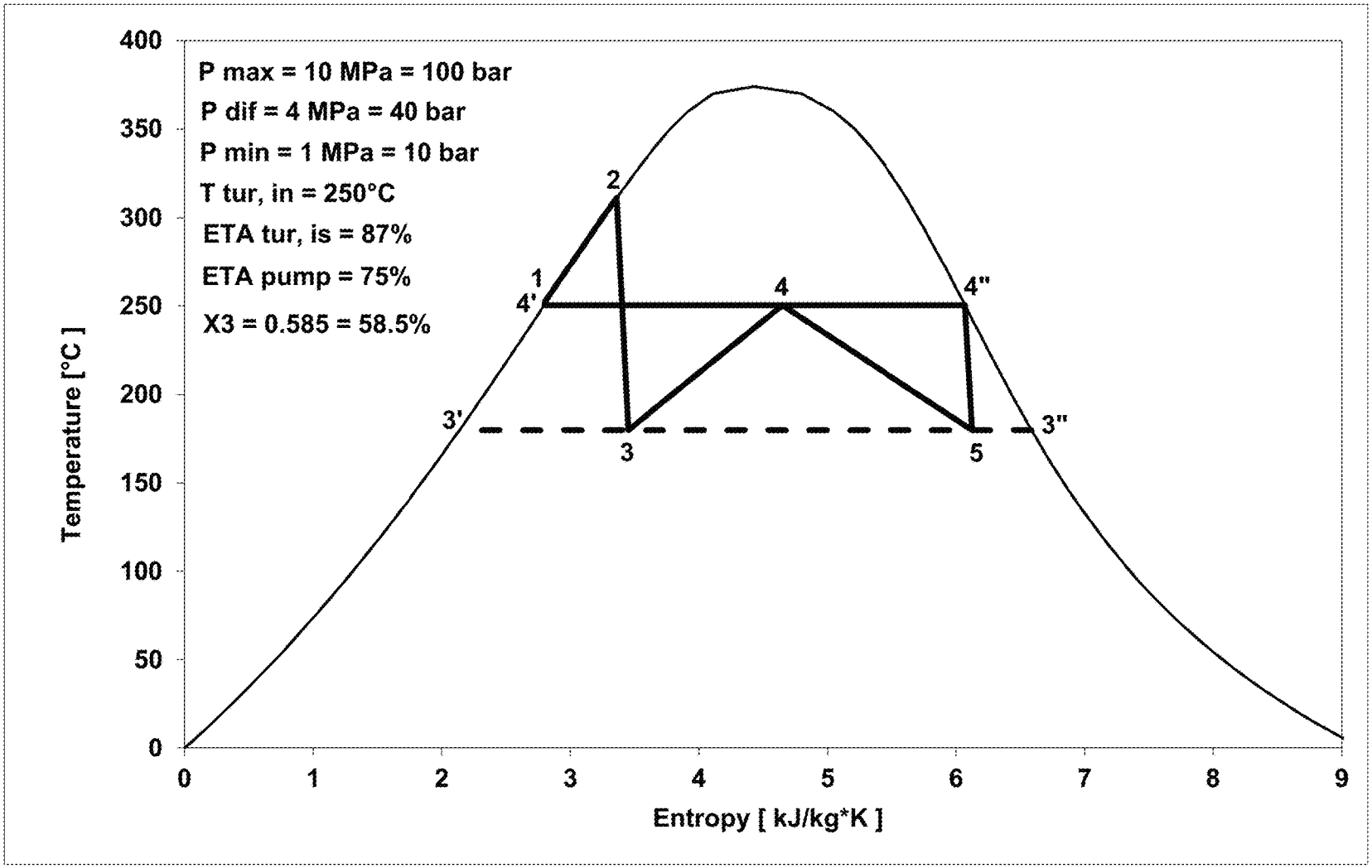
FIG. 2 depicts a temperature/specific-entropy (T-s) diagram corresponding to the modified Rankine-cycle power-plant driven by a wet-vapor-region thermocompressor depicted in FIG. 1.

The main objective of the applied mathematical model is to determine the working fluid conditions at the exit of the diffuser of a wet-vapor-region ejector/thermocompressor in terms of the working fluid conditions at the inlet of the ejector mixing tube. In connection with the mathematical model, FIG. 2 depicts a temperature/specific-entropy (T-s) diagram corresponding to the modified Rankine-cycle power-plant driven by a wet-vapor-region thermocompressor depicted in FIG. 1, wherein the following symbols are used to designate the involved thermodynamic states and processes:

- State 1—pumped primary ejector fluid (saturated water) prior to heating in the liquid/water heater (5)
- State 2—heated primary ejector fluid (saturated water) prior to acceleration in the nozzle (11) of the wet-vapor thermocompressor (10)
- State 3—heated primary ejector fluid (saturated water) after acceleration in the nozzle (11) of the wet-vapor thermocompressor (10)
- State 4—wet-vapor mixture at the exit of the diffuser (15) of the wet-vapor thermocompressor (10)
- State 4'—saturated liquid (water) at static pressure at the exit of the diffuser (15) of the wet-vapor thermocompressor (10), and at the suction of the condensate pump (3)
- State 4"—saturated vapor (dry steam) at static pressure at the exit of the diffuser (15) of the wet-vapor thermocompressor (10), and at the inlet of the backpressure steam turbine (1)
- State 5—secondary ejector fluid (exhausted wet vapor) at the exit of the backpressure steam turbine (1)
- Process 4'-1—Adiabatic pumping of the primary ejector fluid (saturated water) from the diffuser outlet static pressure to the maximum cycle static pressure
- Process 1-2—Isobaric heating of the pumped primary ejector fluid (saturated water) to the maximum cycle temperature in the liquid/water heater (5)
- Process 2-3—Adiabatic acceleration of the heated primary ejector fluid (saturated water) to the minimum static pressure in the nozzle (11)
- Process 4"-5—Adiabatic expansion of the secondary ejector fluid (saturated vapor) in the backpressure steam turbine (1) to the minimum static pressure in the nozzle (11)
- Processes 3-4 and 5-4—Adiabatic compression of the primary ejector fluid (low-quality wet vapor) and the secondary ejector fluid (exhausted high-quality wet vapor), respectively, in the diffuser (15)

Applied mathematical model uses the following simple system of basic fluid-mechanic and thermodynamic equations: conservation of energy equation, expressions for saturated water and saturated vapor (quality) mass fractions in a wet-vapor mixture in equilibrium, wet-vapor enthalpy expression, and the expression for the primary ejector fluid velocity at the nozzle outlet, as follows:

$$\dot{m}_{prim}\cdot\left(h_3+\frac{v_3^2}{2}\right)+\dot{m}_{sec}\cdot\left(h_5+\frac{v_5^2}{2}\right)=(\dot{m}_{prim}+\dot{m}_{sec})\cdot\left(h_4+\frac{v_4^2}{2}\right)$$

$$\dot{m}_{prim}=\dot{m}_{H2O}\cdot(1-x_4)\ \ \&$$

$$\dot{m}_{sec}=\dot{m}_{H2O}\cdot x_4\rightarrow(\dot{m}_{prim}+\dot{m}_{sec})=\dot{m}_{H2O}$$

$$h_4=h_4'+x_4\cdot(h_4''-h_4')\ \ \&$$

$$v_3=\sqrt{2\cdot(h_2-h_3)}$$

where: $m_{prim}$ and $m_{sec}$ [kg/s] are mass flow rates of the primary ejector fluid, or jet/motion fluid (pumped and heated saturated liquid/water in this case) and the secondary ejector fluid, or suction (injected) fluid (exhausted wet vapor in this case), $m_{H2O}$ [kg/s] is total mass flow rate of the wet-vapor mixture, that is, the sum of mass flow rates of the primary and the secondary ejector fluid, $h_2$ [kJ/kg] and $h_3$ [kJ/kg] are enthalpies of the jet/motion fluid prior to and after acceleration in the nozzle (11) of the wet-vapor thermocompressor (10), respectively, $h_4$ [kJ/kg] is enthalpy of the wet-vapor mixture at the exit of the diffuser (15) of the wet-vapor thermocompressor (10), $h_4'$ [kJ/kg] and $h_4''$ [kJ/kg] are saturated liquid (water) and saturated vapor (dry steam) enthalpies, respectively, at static pressure at the exit of the diffuser (15) of the wet-vapor thermocompressor (10), $x_4$ [-] is quality of the wet-vapor mixture at the exit of the diffuser (15) of the wet-vapor thermocompressor (10), $v_3$ [m/s] is velocity of the jet/motion fluid after acceleration in the nozzle (11) of the wet-vapor thermocompressor (10), $v_4$ [m/s] is velocity of the wet-vapor mixture at the exit of the diffuser (15) of the wet-vapor thermocompressor (10), and $v_5$ [m/s] is velocity of the suction (injected) fluid (exhausted wet vapor) at the exit of the backpressure steam turbine (1).

Combining and rearranging the above equations, it is possible to express the vapor quality at the exit of the wet-vapor-region thermocompressor diffuser, $x_4$, as follows:

$$\rightarrow(1-x_4)\cdot h_2+x_4\cdot\left(h_5+\frac{v_5^2}{2}\right)=\left[h_4'+x_4\cdot(h_4''-h_4')+\frac{v_4^2}{2}\right]\rightarrow$$

$$\rightarrow h_2-h_4'-\frac{v_4^2}{2}=x_4\cdot\left(h_4''-h_4'+h_2-h_5-\frac{v_5^2}{2}\right)\rightarrow$$

$$\boxed{\rightarrow x_4=\frac{\left(h_2-h_4'-\frac{v_4^2}{2}\right)}{\left(h_4''-h_4'+h_2-h_5-\frac{v_5^2}{2}\right)}}$$

Thermal efficiency $\eta_{i,turb}$ of the modified Rankine cycle without cycle-heat rejection and driven by a wet-vapor-region thermocompressor is then defined according to the following expression:

$$\boxed{\eta_{cycle}=\frac{x_4\cdot(h_4''-h_5)-(1-x_4)\cdot(h_1-h_4')}{(1-x_4)\cdot(h_2-h_1)}}$$

where: $h_1$ [kJ/kg] is enthalpy of the pumped primary ejector fluid (saturated water) prior to heating in the liquid/water heater (5).

The above explained mathematical model has been based on the general assumption of uniformity of static pressure across the mixing-tube/chamber inlet: ($p_3/p_5$=1.0), where $p_5$ [kPa] is static pressure of the secondary ejector fluid (exhausted wet vapor) after adiabatic expansion in the backpressure steam turbine (1), while $p_3$ [kPa] is static pressure of the primary ejector fluid (saturated water) after adiabatic acceleration in the nozzle (11).

To show potential extraordinary gains in cycle thermal efficiency of the thus modified Rankine cycle driven and augmented by the proposed wet-vapor-region thermocompressor, the following exemplary case #1 has been chosen, adopting the following general assumptions: overall efficiency of the condensate pump of $\eta_{pump}$=75%, the backpressure-steam-turbine isentropic efficiency of $\eta_{i,turb}$=87%, the maximum cycle static pressure of $p_1=p_2$=10 MPa (100 bar or 1,450 psi), the minimum static pressure at the outlet of the nozzle (11) of $p_3=p_5$=1 MPa (10 bar or 145 psi), the designed static pressure at the outlet of the diffuser (15) of $p_4$=4 MPa (40 bar or 580 psi), velocity of the wet-vapor mixture at the exit of the diffuser (15) of $v_{4=200}$ m/s, and velocity of the secondary ejector fluid (exhausted wet vapor) at the exit of the backpressure steam turbine (1) of $v_5$=100 m/s. Neglecting pressure drop in the liquid/water heater (5), the calculation shows that the following cycle thermal efficiency of the proposed modified Rankine-cycle driven by the wet-vapor-region thermocompressor is achievable:

$$\text{for } p_2=10\,MPa=100\text{ bar}\rightarrow h_2=h_2'=1407.7\ \frac{kJ}{kg},\ s_2'=3.360\ \frac{kJ}{kg\cdot K}$$

$$\text{for } p_4=4\,MPa=40\text{ bar}\rightarrow h_4'=1087.5\ \frac{kJ}{kg},\ \rho_4'=798.7\ \frac{kg}{m^3},$$

$$s_4'=2.796\ \frac{kJ}{kg\cdot K}\ \ \&\ h_4''=2801\ \frac{kJ}{kg},\ s_4''=6.070\ \frac{kJ}{kg\cdot K}$$

$$\text{for } p_{3\equiv5}=1\,MPa=10\text{ bar}\rightarrow h_{3\equiv5}'=762.7\ \frac{kJ}{kg},$$

$$s_{3\equiv5}'=2.138\ \frac{kJ}{kg\cdot K}\ \ \&\ h_{3\equiv5}''=2778\ \frac{kJ}{kg},\ s_{3\equiv5}''=6.587\ \frac{kJ}{kg\cdot K}$$

$$\text{for } \eta_{i,turb}=87\%=0.87\rightarrow h_5$$

$$=h_4''-\eta_{i,turb}\cdot\left\{h_4''-\left[h_{3\equiv5}'+(h_{3\equiv5}''-h_{3\equiv5}')\cdot\frac{(s_4''-s_{3\equiv5}')}{(s_{3\equiv5}''-s_{3\equiv5}')}\right]\right\}$$

$$=2801\ \frac{kJ}{kg}-0.87\cdot$$

$$\left\{2801-\left[762.7+(2778-762.7)\cdot\frac{(6.07-2.138)}{(6.587-2.138)}\right]\right\}\left[\frac{kJ}{kg}\right]$$

$$=2577.245\ \frac{kJ}{kg}$$

$$\text{for } \eta_{pump}=75\%=0.75\rightarrow h_1=h_4'+\frac{1}{\eta_{pump}}\cdot\frac{(p_{1\equiv2}-p_4)}{\rho_4'}$$

$$=1087.5\ \frac{kJ}{kg}-\frac{1}{0.75}\cdot\frac{(10000-4000)\left[kPa\equiv\frac{kN}{m^2}\right]}{\left(798.7\ \frac{kg}{m^3}\right)}=1097.5\ \frac{kJ}{kg}$$

$$\text{for } v_4=200\ \frac{m}{s}\rightarrow x_4=\frac{\left(h_2-h_4'-\frac{v_5^2}{2}\right)}{\left(h_4''-h_4'+h_2-h_5-\frac{v_5^2}{2}\right)}=$$

$$\frac{\left(1407.7-1087.5-\frac{200^2}{2000}\right)}{\left(2801-1087.5+1407.7-2577.245-\frac{100^2}{2000}\right)}=0.557$$

-continued $$\eta_{cycle} = \frac{x_4 \cdot (h_4'' - h_5) - (1 - x_4) \cdot (h_1 - h_4')}{(1 - x_4) \cdot (h_2 - h_1)} = \frac{0.557 \cdot (2801 - 2577.245) - (1 - 0.557) \cdot (10)}{(1 - 0.557) \cdot (1407.7 - 1097.5)} = 0.8747 = 87.47\%$$

The calculated cycle thermal efficiency of 87.47% is already extraordinary high and higher than the corresponding Carnot cycle efficiency. However, the cycle thermal efficiency can be even higher, ideally close to 100%, when the velocity of the wet-vapor mixture at the exit of the diffuser (15) becomes equal to the velocity of the secondary ejector fluid (exhausted wet vapor) at the exit of the backpressure steam turbine (1), that is, when $v_4=v_5=100$ m/s:

$$\text{for } v_4 = v_{4,min} \rightarrow x_{4,max} = \frac{\left(h_2 - h_4' - \frac{v_{4,min}^2}{2}\right)}{\left(h_4'' - h_4' + h_2 - h_5 - \frac{v_5^2}{2}\right)}$$

$$\text{for } v_{4,min} = v_5 = 100\ \frac{\text{m}}{\text{s}} \rightarrow x_{4,max} = \frac{\left(h_2 - h_4' - \frac{v_{4,min}^2}{2}\right)}{\left(h_4'' - h_4' + h_2 - h_5 - \frac{v_5^2}{2}\right)} = \frac{\left(1407.7 - 1087.5 - \frac{100^2}{2000}\right)}{\left(2801 - 1087.5 + 1407.7 - 2577.245 - \frac{100^2}{2000}\right)} = 0.584835$$

$$\eta_{cycle,max} = \frac{x_{4,max} \cdot (h_4'' - h_5) - (1 - x_{4,max}) \cdot (h_1 - h_4')}{(1 - x_{4,max}) \cdot (h_2 - h_1)} = \frac{0.584835 \cdot (2801 - 2577.245) - (1 - 0.584835) \cdot (10)}{(1 - 0.584835) \cdot (1407.7 - 1097.5)} = 0.98388 = 98.388\%$$

The above calculation result shows that nearly 100%-cycle-thermal-efficiency can be obtained using the basic configuration (FIG. 1) of the modified Rankine cycle driven by the wet-vapor-region thermocompressor, provided the velocity of the wet-vapor mixture at the exit of the diffuser (15) is equal to the velocity of the secondary ejector fluid (exhausted wet vapor) at the exit of the backpressure steam turbine (1), that is, when $v_4=v_5$. It also has to be noted that the quality of the wet-vapor mixture at the exit of the diffuser (15) indicated in FIG. 2 should read "$x_4$" (more precise "$x_{4,max}$") instead of "$x_3$". Similarly, the backpressure-steam-turbine isentropic efficiency indicated in in FIG. 2 should read "$ETA_{tur,is}$=87%" instead of "$ETA_{tur,is}$=90%".

In relation to inequality of the velocity of the wet-vapor mixture at the exit of the diffuser (15) (assumed $v_{4=200}$ m/s) and the velocity of the secondary ejector fluid (exhausted wet vapor) at the exit of the backpressure steam turbine (1) (assumed $v_5=100$ m/s), it is interesting and illustrative to estimate a corresponding effectiveness of the diffuser (15), $\eta_{diff}$, as follows:

$$\text{for } x_{3\equiv5} = x_4 \rightarrow h_{3\equiv5} = h_{3\equiv5}' + x_4 \cdot (h_{3\equiv5}'' - h_{3\equiv5}')$$

$$\text{for } x_4 = 0.557 \rightarrow h_4 = h_4' + x_4 \cdot (h_4'' - h_4') = [1087.5 + 0.557 \cdot (2801 - 1087.5)] \left[\frac{kJ}{\text{kg}}\right] = 2041.9195\ \frac{kJ}{\text{kg}}$$

-continued $$\text{for } x_{4,max} = 0.584835 \rightarrow h_{4,id} = h_4' + x_{4,max} \cdot (h_4'' - h_4') = [1087.5 + 0.584835 \cdot (2801 - 1087.5)] \left[\frac{kJ}{\text{kg}}\right] = 2089.616\ \frac{kJ}{\text{kg}}$$

$$\text{for } x_{4,max} = 0.584835 \rightarrow h_{3\equiv5,id} = h_{3\equiv5}' + x_{4,max} \cdot (h_{3\equiv5}'' - h_{3\equiv5}') = [762.7 + 0.584835 \cdot (2778 - 762.7)] \left[\frac{kJ}{\text{kg}}\right] = 1941.319\ \frac{kJ}{\text{kg}}$$

$$\boxed{\rightarrow \eta_{diff} = \frac{(h_4 - h_{3\equiv5,id})}{(h_{4,id} - h_{3\equiv5,id})}}$$

$$\eta_{diff} = \frac{(h_4 - h_{3\equiv5,id})}{(h_{4,id} - h_{3\equiv5,id})} = \frac{(2041.9195 - 1941.319)}{(2089.616 - 1941.319)} = 0.67837 = 67.84\%$$

Calculation of Exemplary Case #2

Figure 4:
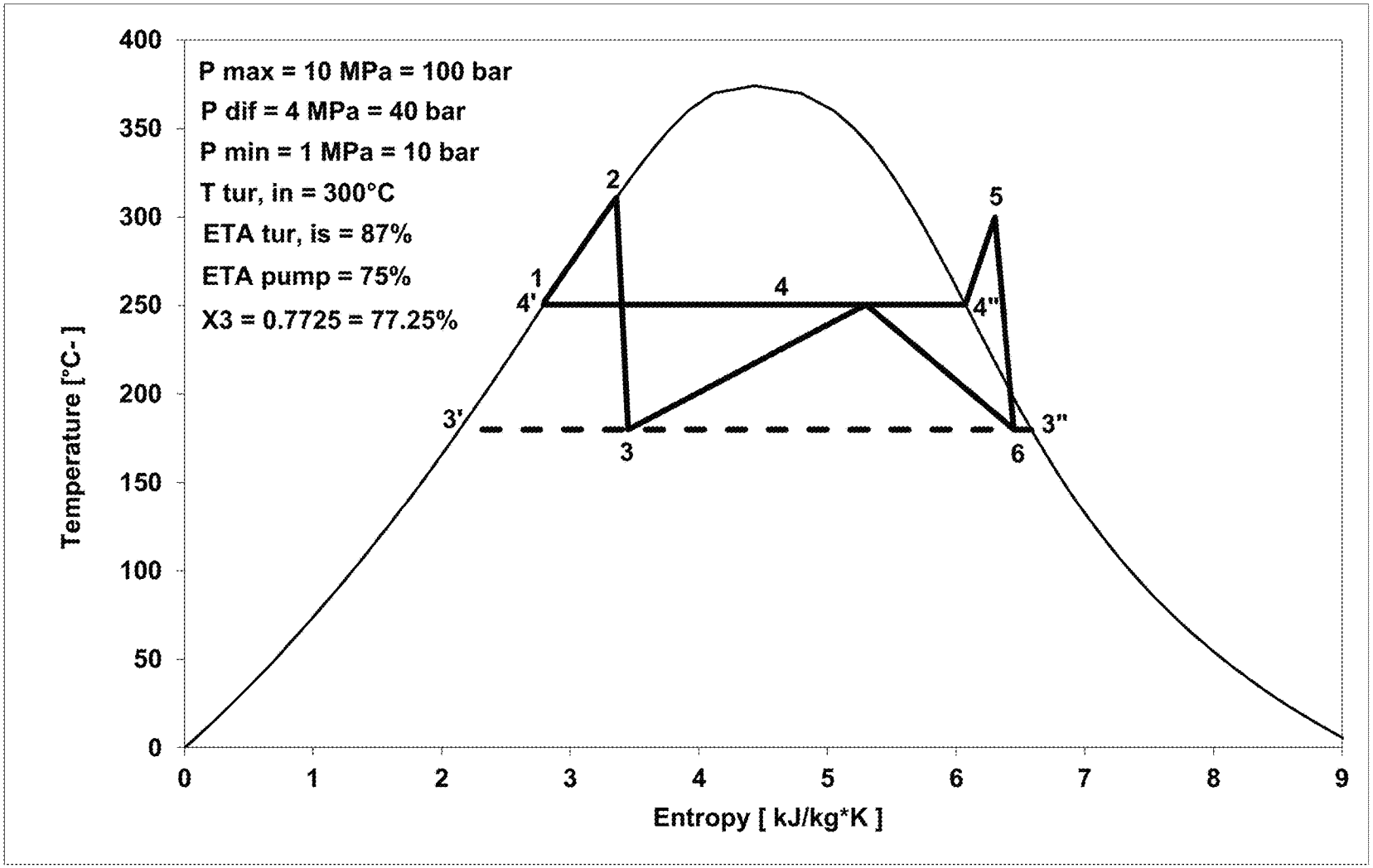
FIG. 4 depicts a temperature/specific-entropy (T-s) diagram corresponding to the modified Rankine-cycle power-plant driven by a wet-vapor-region thermocompressor depicted in FIG. 3.

Exemplary case #2 described by the above explained mathematical model relates to FIG. 4, which depicts a temperature/specific-entropy (T-s) diagram corresponding to the modified Rankine-cycle power-plant driven by a wet-vapor-region thermocompressor depicted in FIG. 3. The main difference of FIG. 3 relative to FIG. 1 is use of the additional heat exchanger/superheater (6) for isobaric heat addition to the saturated vapor (gas fraction) separated in the cylindrical separation tank (2), to the end superheating of the saturated vapor and thus enabling the backpressure steam turbine (1) to operate with superheated steam at its inlet, resulting in an increased steam-turbine specific work for the same expansion pressure ratio. The following symbols are used to designate additionally involved/altered thermodynamic states and processes:

- State 5—heated primary ejector fluid (superheated vapor/steam) prior to adiabatic expansion in the backpressure steam turbine (1)
- State 6—secondary ejector fluid (exhausted wet vapor) at the exit of the backpressure steam turbine (1)
- Process 4"-5—Isobaric heating of the primary ejector fluid (saturated vapor) to a maximum chosen steam temperature in the additional heat exchanger/superheater (6)
- Process 5-6—Adiabatic expansion of the secondary ejector fluid (superheated vapor/steam) in the backpressure steam turbine (1) to the minimum static pressure in the nozzle (11)

The following expressions determine: quality of the wet-vapor mixture at the exit of the diffuser ($x_{4,II}$), thermal efficiency of the modified Rankine cycle ($\eta_{cycle,II}$) and effectiveness of the diffuser ($\eta_{diff}$), respectively:

$$\boxed{\rightarrow x_{4,II} = \frac{\left(h_2 - h_4' - \frac{v_4^2}{2}\right)}{\left(h_4'' - h_4' + h_2 - h_6 - \frac{v_6^2}{2}\right)}}$$

$$\boxed{\eta_{cycle,II} = \frac{x_{4,II} \cdot (h_5 - h_6) - (1 - x_{4,II}) \cdot (h_1 - h_4')}{(1 - x_{4,II}) \cdot (h_2 - h_1) + x_{4,II} \cdot (h_5 - h_4'')}}$$

$$\boxed{\rightarrow \eta_{diff,II} = \frac{(x_{4,II} - h_{3\equiv6,II,id})}{(x_{4,II,id} - h_{3\equiv6,II,id})}}$$

where: $h_2$ [kJ/kg] is enthalpy of the jet/motion fluid prior to acceleration in the nozzle (11) of the wet-vapor thermocompressor (10), $h_{4,II}$ [kJ/kg] is enthalpy of the wet-vapor mixture at the exit of the diffuser (15) of the wet-vapor thermocompressor (10), $h_4'$ [kJ/kg] and $h_4''$ [kJ/kg] are saturated liquid (water) and saturated vapor (dry steam) enthalpies, respectively, at static pressure at the exit of the diffuser (15) of the wet-vapor thermocompressor (10), $x_{4,II}$ [-] is quality of the wet-vapor mixture at the exit of the diffuser (15) of the wet-vapor thermocompressor (10), $h_5$ and $h_6$ [kJ/kg] are enthalpies of the suction (injected) fluid (superheated steam and exhausted wet vapor) prior to and after adiabatic expansion in the backpressure steam turbine (1), $v_4$ [m/s] is velocity of the wet-vapor mixture at the exit of the diffuser (15) of the wet-vapor thermocompressor (10), and $v_6$ [m/s] is velocity of the suction (injected) fluid (exhausted wet vapor) at the exit of the backpressure steam turbine (1).

The chosen exemplary case #2 adopts the following additional/altered general assumptions: the maximum steam temperature in the additional heat exchanger/superheater (6) of $T_5$=300° C. (573 K or 572° F.) at the designed static pressure at the outlet of the diffuser (15) of $p_4$=4 MPa (40 bar or 580 psi), velocity of the wet-vapor mixture at the exit of the diffuser (15) of $v_4$=200 m/s, and velocity of the secondary ejector fluid (exhausted wet vapor) at the exit of the backpressure steam turbine (1) of $v_6$=100 m/s. Neglecting pressure drops in both the liquid/water heater (5) and the additional heat exchanger/superheater (6), the calculation shows that the following cycle thermal efficiency of the proposed modified Rankine-cycle driven by the wet-vapor-region thermocompressor is achievable:

$$\text{for } p_{4\equiv5} = 4\,MPa = 40 \text{ bar } \;\&\; T_5 = 300^\circ \text{ C.} \rightarrow h_5 = 2955\ \frac{kJ}{\text{kg}},\quad s_5 = 6.352\ \frac{kJ}{\text{kg}\cdot\text{K}}$$

$$\text{for } p_{3\equiv6} = 1\,MPa = 10 \text{ bar} \rightarrow h'_{3\equiv6} = 762.7\ \frac{kJ}{\text{kg}},\quad s'_{3\equiv6} = 2.138\ \frac{kJ}{\text{kg}\cdot\text{K}}\ \;\&\; h''_{3\equiv6} = 2778\ \frac{kJ}{\text{kg}},\ s''_{3\equiv6} = 6.587\ \frac{kJ}{\text{kg}\cdot\text{K}}$$

$$\text{for } \eta_{i,turb} = 87\% = 0.87 \rightarrow h_6$$

$$= h_5 - \eta_{i,turb}\cdot\left\{h_5 - \left[h'_{3\equiv6} + (h''_{3\equiv6} - h'_{3\equiv6})\cdot\frac{(s_5 - s'_{3\equiv6})}{(s''_{3\equiv6} - s'_{3\equiv6})}\right]\right\}$$

$$= 2955\ \frac{kJ}{\text{kg}} - 0.87\cdot\left\{2955 - \left[762.7 + (2778 - 762.7)\cdot\frac{(6.352 - 2.138)}{(6.587 - 2.138)}\right]\right\}\left[\frac{kJ}{\text{kg}}\right]$$

$$= 2708.4\ \frac{kJ}{\text{kg}}$$

$$\text{for } v_{4,min} = v_6 = 100\ \frac{\text{m}}{\text{s}} \rightarrow x_{4,II,max} = \frac{\left(h_2 - h'_4 - \frac{v_{4,min}^2}{2}\right)}{\left(h''_4 - h'_4 + h_2 - h_6 - \frac{v_6^2}{2}\right)} = \frac{\left(1407.7 - 1087.5 - \frac{100^2}{2000}\right)}{\left(2801 - 1087.5 + 1407.7 - 2708.4 - \frac{100^2}{2000}\right)} = 0.772928$$

$$\text{for } v_4 = 200\ \frac{\text{m}}{\text{s}} \rightarrow x_{4,II} = \frac{\left(h_2 - h'_4 - \frac{v_4^2}{2}\right)}{\left(h''_4 - h'_4 + h_2 - h_6 - \frac{v_6^2}{2}\right)} =$$

-continued $$\frac{\left(1407.7 - 1087.5 - \frac{100^2}{2000}\right)}{\left(2801 - 1087.5 + 1407.7 - 2708.4 - \frac{100^2}{2000}\right)} = 0.736145$$

$$\eta_{cycle,II} = \frac{x_{4,II}\cdot(h_5 - h_6) - (1 - x_{4,II})\cdot(h_1 - h'_4)}{(1 - x_{4,II})\cdot(h_2 - h_1) + x_{4,II}\cdot(h_5 - h''_4)} = \frac{0.736145\cdot(2955 - 2708.4) - (1 - 0.736145)\cdot(10)}{(1 - 0.736145)\cdot(1407.7 - 1097.5) + 0.736145\cdot(2955 - 2801)} = 0.9164 = 91.64\%$$

$$\eta_{cycle,II,max} = \frac{x_{4,II,max}\cdot(h_5 - h_6) - (1 - x_{4,II,max})\cdot(h_1 - h'_4)}{(1 - x_{4,II,max})\cdot(h_2 - h_1) + x_{4,II,max}\cdot(h_5 - h''_4)} = \frac{0.772928\cdot(2955 - 2708.4) - (1 - 0.772928)\cdot(10)}{(1 - 0.772928)\cdot(1407.7 - 1097.5) + 0.772928\cdot(2955 - 2801)} = 0.994 = 99.4\%$$

$$\text{for } x_{4,II} = 0.736145 \rightarrow h_{4,II} = h'_4 + x_{4,II}\cdot(h''_4 - h'_4) = [1087.5 + 0.736145\cdot(2801 - 1087.5)]\left[\frac{kJ}{\text{kg}}\right] = 2348.884\ \frac{kJ}{\text{kg}}$$

$$\text{for } x_{4,II,max} = 0.772928 \rightarrow h_{4,II,id} = h'_4 + x_{4,II,max}\cdot(h''_4 - h'_4) = [1087.5 + 0.772928\cdot(2801 - 1087.5)]\left[\frac{kJ}{\text{kg}}\right] = 2411.912\ \frac{kJ}{\text{kg}}$$

$$\text{for } x_{4,II,max} = 0.772928 \rightarrow h_{3\equiv6,II,id} = h'_{3\equiv6} + x_{4,II,max}\cdot(h''_{3\equiv6} - h'_{3\equiv6}) = [762.7 + 0.772928\cdot(2778 - 762.7)]\left[\frac{kJ}{\text{kg}}\right] = 2320.3816\ \frac{kJ}{\text{kg}}$$

$$\eta_{diff,II} = \frac{(h_{4,II} - h_{3\equiv6,II,id})}{(h_{4,II,id} - h_{3\equiv6,II,id})} = \frac{(2348.884 - 2320.3816)}{(2411.912 - 2320.3816)} = 0.3114 = 31.14\%$$

Similarly to conclusion for the exemplary case #1, the above calculation result for the exemplary case #2 shows that nearly 100%-cycle-thermal-efficiency can be obtained even more easily using the altered configuration (FIG. 3) of the modified Rankine cycle driven by the wet-vapor-region thermocompressor, provided the velocity of the wet-vapor mixture at the exit of the diffuser (15) is equal to the velocity of the secondary ejector fluid (exhausted wet vapor) at the exit of the backpressure steam turbine (1), that is, when $v_4$=$v_5$. Similarly to FIG. 2, here it also has to be noted that the quality of the wet-vapor mixture at the exit of the diffuser (15) indicated in FIG. 4 should read "$x_4$" (more precise "$x_{4,max}$") instead of "$x_3$", while the backpressure-steam-turbine isentropic efficiency indicated in in FIG. 2 should read "$ETA_{tur,is}$=87%" instead of "$ETA_{tur,is}$=90%".

In the above calculations of exemplary cases #1 and #2 it has been assumed that the pressure recovery ratio of the said thermocompressor (10) is 4:1, which may seem an overestimation. However, similar calculation results and cycle efficiencies would have been obtained even for a much lower assumed thermocompressor pressure recovery ratio of 2:1. For such or even lower thermocompressor pressure recovery ratios, it is recommendable and feasible to use the said optional steam compressor (18), which artificially increases the pressure recovery ratio of the said thermocompressor (10), thus allowing the said backpressure steam turbine (1) driving the said steam compressor (18) to still achieve a positive net surplus work.

All numbers expressing process or cycle parameters, cycle thermal efficiencies, specific cycle outputs, and so forth, used in this specification and claims are to be understood as being modified in all instances by the term "about" or "approximately". The matter set forth in the foregoing description and accompanying drawings is offered by way of illustration only and not as a limitation. Since further modifications, applications or adaptations of the invention may become apparent to those skilled in the art, aim of the appended patent claims is to cover all such changes and modifications as fall within the true spirit and scope of the invention.

The invention claimed is:

1. A modified Rankine-cycle power-plant without cycle-heat rejection driven by a thermocompressor (ejector) operating in the wet-vapor region, consisting of the following interconnected equipment/processes:

a) a wet-vapor-region thermocompressor/ejector (10), consisting of: a supersonic nozzle (11), for acceleration of the high-pressure high-temperature liquid of a working fluid, comprising subcooled water or a low-quality water-vapor mixture, a conical part (12) of the ejector mixing chamber for admission of exhausted wet vapor from a backpressure steam turbine (1), a long constant-diameter part (14) of the said ejector mixing chamber for mixing and deceleration/acceleration of the water-vapor mixture in the form of one or more normal shock waves, and a subsonic diffuser (15) for subsonic deceleration of the mixed water-vapor mixture;

b) a cylindrical separator/separation tank (2) for as-complete-as-possible separation of the wet water-vapor mixture exiting the said diffuser (15) of the said thermocompressor (10), using a dry-pipe steam separator having of a plurality of holes at the top and two holes at the bottom half, whereas the turbulently moving steam-water mixture is directed through the top half holes of the dry pipe and forced to separate between water and steam, whereby the separated steam flows to the said backpressure steam turbine (1) and the separated water drops down to the bulk liquid through bottom holes;

c) the said backpressure steam turbine (1) for adiabatic expansion of the saturated vapor (gas fraction) separated in the said cylindrical separator/separation tank (2), exhausting wet vapor to the said conical part (12) of the said ejector mixing chamber of the said thermocompressor (10), driving a load (8) via a connecting shaft;

d) a steam compressor (18) preceding the said backpressure steam turbine (1), mounted on the same connecting shaft with the said load (8) and driven by the said backpressure steam turbine (1), which serves for pre-compression of a secondary ejector fluid, that is, saturated steam/vapor separated in the said cylindrical separator/separation tank (2), prior to its expansion in the said backpressure steam turbine (1), thus artificially increasing the pressure recovery ratio of the said wet-vapor thermocompressor (10) which is obtainable at an ejector entrainment ratio, which is a ratio of mass flow rates of suction and driving fluid and is defined by the vapor quality at the outlet of the said diffuser (15), so that it matches the chosen expansion pressure ratio of the said backpressure steam turbine (1);

e) the said load (8), comprising an electric generator, driven by the said backpressure steam turbine (1) via the said connecting shaft, so that it converts mechanical energy of the said steam turbine (1) into the generator's electrical energy supplied to a power grid;

f) a condensate pump (3) for pressurizing and circulation of the liquid working fluid, which is saturated water separated in the said cylindrical separator/separation tank (2);

g) a stop valve (4) at the discharge side of the said condensate pump (3) for starting up of the said pump (3) and of the entire working-fluid circulation loop; and h) a liquid/water heat exchanger (5) for isobaric heat addition to the liquid working fluid, being subcooled water or a low-quality water-vapor mixture, either directly heated by a fuel or indirectly heated by heat exchange with any source of heat contained in a primary heat-exchange fluid, thereby supplying the heated liquid working fluid to the said nozzle (11) of the said thermocompressor (10), to the end of re-pressurizing of the secondary ejector fluid, which is exhausted wet vapor from the said backpressure steam turbine (1)).

2. The configuration of the modified Rankine-cycle power-plant without cycle-heat rejection and driven by a wet-vapor-region thermocompressor of claim 1, further comprising the use of an additional heat exchanger/superheater (6) for isobaric heat addition to the saturated vapor (gas fraction) separated in the said cylindrical separator/separation tank (2), to the end superheating of the saturated vapor and thus enabling the said backpressure steam turbine (1) to operate with superheated steam at its inlet, resulting in an increased steam-turbine specific work for the same expansion pressure ratio; whereby the said steam compressor (18) precedes the said additional heat exchanger/superheater (6) of the saturated vapor—the gas fraction being separated in the said cylindrical separator/separation tank (2)), which itself precedes the said backpressure steam turbine (1).

3. The configuration of the modified Rankine-cycle power-plant without cycle-heat rejection and driven by a wet-vapor-region thermocompressor of claim 1, whereby the said cylindrical separator/separation tank (2) used for as-complete-as-possible separation of the wet water-vapor mixture exiting the said diffuser (15) of the said thermocompressor (10), using: (i) a baffle-plate steam separator having the said cylindrical separation tank (2) fitted with two (2) to three (3) baffle plates, which serve to change the direction of the incoming steam flow when the steam strikes the baffle plates, prompting heavier water particles contained in the steam-water mixture to fall down to the bottom of the separation tank, while the separated steam is freed from water particles and passed to the said backpressure steam turbine (1); or (ii) a centrifugal/cyclone steam separator for more turbulent flows, having the said cylindrical separation tank (2) fitted with at least one cyclone, which utilizes centrifugal force to separate water and steam from the steam-water mixture, whereby the steam-water mixture is forced to move around the cyclone and make the rotation.

4. The configuration of the modified Rankine-cycle power-plant without cycle-heat rejection and driven by a wet-vapor-region thermocompressor of claim 2, whereby the said cylindrical separator/separation tank (2) used for as-complete-as-possible separation of the wet water-vapor mixture exiting the said diffuser (15) of the said thermocompressor (10), using: (i) a baffle-plate steam separator having the said cylindrical separation tank (2) fitted with two (2) to three (3) baffle plates, which serve to change the direction of the incoming steam flow when the steam strikes the baffle plates, prompting heavier water particles contained in the steam-water mixture to fall down to the bottom of the separation tank, while the separated steam is freed from water particles and passed to the said backpressure steam turbine (1); or (ii) a centrifugal/cyclone steam separator for more turbulent flows, having the said cylindrical separation tank (2) fitted with at least one cyclone, which utilizes centrifugal force to separate water and steam from the steam-water mixture, whereby the steam-water mixture is forced to move around the cyclone and make the rotation.

5. The configuration of the modified Rankine-cycle power-plant configuration without cycle-heat rejection and driven by a wet-vapor-region thermocompressor of claim 1, which uses either of the following heat sources transferring the cycle heat to the said liquid/water heater (5) by an indirect heat exchange: (a) a solid, liquid or gaseous fossil fuel (coal, fuel oil, solid/liquid waste fuel, natural gas, synthesis gas or any other waste gas); (b) renewable energy sources in the form of either Solar energy, biomass or geothermal energy, (c) the waste heat of a natural-gas-fired combined cycle (50), or (d) any of the following types of commercial nuclear reactors: a light-water-moderated pressurized-water thermal nuclear reactor (30), a heavy-water-moderated pressurized-heavy-water thermal nuclear reactor, a light-water-moderated boiling-water thermal nuclear reactor (40), a graphite-moderated molten salt thermal nuclear reactor, a graphite-moderated gas-cooled thermal nuclear reactor using a suitable cooling gas, such as helium, $CO_2$ or any suitable mixture of gases, or a liquid-metal-cooled fast-neutron nuclear reactor.

6. The configuration of the modified Rankine-cycle power-plant configuration without cycle-heat rejection and driven by a wet-vapor-region thermocompressor of claim 2, which uses either of the following heat sources transferring the cycle heat both to the said liquid/water heater (5) and the said superheater (6) by an indirect heat exchange: (a) a solid, liquid or gaseous fossil fuel (coal, fuel oil, solid/liquid waste fuel, natural gas, synthesis gas or any other waste gas); (b) renewable energy sources in the form of either Solar energy, biomass or geothermal energy, (c) the waste heat of a natural-gas-fired combined cycle (50), or (d) any of the following types of commercial nuclear reactors: a light-water-moderated pressurized-water thermal nuclear reactor (30), a heavy-water-moderated pressurized-heavy-water thermal nuclear reactor, a light-water-moderated boiling-water thermal nuclear reactor (40), a graphite-moderated molten salt thermal nuclear reactor, a graphite-moderated gas-cooled thermal nuclear reactor using a suitable cooling gas, such as helium, $CO_2$ or any suitable mixture of gases, or a liquid-metal-cooled fast-neutron nuclear reactor.

7. The configuration of the modified Rankine-cycle power-plant configuration without cycle-heat rejection and driven by a wet-vapor-region thermocompressor of claim 3, which uses either of the following heat sources transferring the cycle heat to the said liquid/water heater (5) by an indirect heat exchange: (a) a solid, liquid or gaseous fossil fuel (coal, fuel oil, solid/liquid waste fuel, natural gas, synthesis gas or any other waste gas); (b) renewable energy sources in the form of either Solar energy, biomass or geothermal energy, (c) the waste heat of a natural-gas-fired combined cycle (50), or (d) any of the following types of commercial nuclear reactors: a light-water-moderated pressurized-water thermal nuclear reactor (30), a heavy-water-moderated pressurized-heavy-water thermal nuclear reactor, a light-water-moderated boiling-water thermal nuclear reactor (40), a graphite-moderated molten salt thermal nuclear reactor, a graphite-moderated gas-cooled thermal nuclear reactor using a suitable cooling gas, such as helium, $CO_2$ or any suitable mixture of gases, or a liquid-metal-cooled fast-neutron nuclear reactor.

8. The configuration of the modified Rankine-cycle power-plant configuration without cycle-heat rejection and driven by a wet-vapor-region thermocompressor of claim 4, which uses either of the following heat sources transferring the cycle heat both to the said liquid/water heater (5) and the said superheater (6) by an indirect heat exchange: (a) a solid, liquid or gaseous fossil fuel (coal, fuel oil, solid/liquid waste fuel, natural gas, synthesis gas or any other waste gas); (b) renewable energy sources in the form of either Solar energy, biomass or geothermal energy, (c) the waste heat of a natural-gas-fired combined cycle (50), or (d) any of the following types of commercial nuclear reactors: a light-water-moderated pressurized-water thermal nuclear reactor (30), a heavy-water-moderated pressurized-heavy-water thermal nuclear reactor, a light-water-moderated boiling-water thermal nuclear reactor (40), a graphite-moderated molten salt thermal nuclear reactor, a graphite-moderated gas-cooled thermal nuclear reactor using a suitable cooling gas, such as helium, $CO_2$ or any suitable mixture of gases, or a liquid-metal-cooled fast-neutron nuclear reactor.

9. A method for regulation of the cycle output/load of the proposed modified Rankine-cycle power-plant without cycle-heat rejection of claim 1 in working regimes other than the nominal working regime, using either (a) qualitative regulation of the cycle output/load by alteration of the steam-turbine inlet temperature via the cycle heat input or (b) quantitative regulation of the cycle output/load by alteration of the steam-turbine mass flow rate using bypassing of the said backpressure steam turbine (1) via a bypass valve and a subsequent external cooling of the corresponding portion of the steam-turbine bypass mass flow rate using an external water or air cooler (17), up to the steam-turbine (1) outlet temperature existing in the nominal cycle working regime.

* * * * *